US009944096B2

(12) United States Patent
Kudo

(10) Patent No.: US 9,944,096 B2
(45) Date of Patent: Apr. 17, 2018

(54) RECORDING APPARATUS, AND METHOD FOR CONTROLLING RECORDING APPARATUS

(71) Applicant: CANON KABUSHIKI KAISHA, Tokyo (JP)

(72) Inventor: Naotoshi Kudo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/285,020

(22) Filed: Oct. 4, 2016

(65) Prior Publication Data

US 2017/0100946 A1 Apr. 13, 2017

(30) Foreign Application Priority Data

Oct. 9, 2015 (JP) ..... 2015-201313

(51) Int. Cl.
*B41J 13/00* (2006.01)
*B41J 2/01* (2006.01)
*B41J 29/393* (2006.01)

(52) U.S. Cl.
CPC ..... *B41J 13/0009* (2013.01); *B41J 2/01* (2013.01); *B41J 29/393* (2013.01)

(58) Field of Classification Search
CPC ..... B41J 13/0009; B41J 13/0018; B41J 13/0072; B41J 13/042; B41J 11/0092; B41J 29/393
See application file for complete search history.

(56) References Cited

U.S. PATENT DOCUMENTS 5,671,474 A * 9/1997 Fukano ..... G03G 15/206 399/328
6,435,446 B1 * 8/2002 Matsuzawa ..... B65H 16/00 242/422.4
7,165,902 B2 * 1/2007 Ejiri ..... B41J 13/0018 271/225
2001/0035724 A1 * 11/2001 Tanaka ..... B41J 11/0065 318/445
2010/0090396 A1 * 4/2010 Shinjo ..... B65H 5/062 271/273
2012/0056365 A1 3/2012 Kato
2012/0153000 A1 * 6/2012 Hata ..... B41J 11/009 226/168

FOREIGN PATENT DOCUMENTS

JP H07257767 A 10/1995
JP 2012-139998 A 7/2012

* cited by examiner

*Primary Examiner* — Sharon A Polk
(74) *Attorney, Agent, or Firm* — Canon USA, Inc. I.P. Division

(57) ABSTRACT

A recording apparatus includes a plurality of feeding units each configured to feed a sheet, a conveyance unit configured to convey the sheet to this recording unit, a first detection unit provided on an upstream side of the recording unit in a direction in which the sheet is conveyed and configured to detect whether there is the sheet, a driving control unit configured to control driving of a motor for conveying a roll sheet fed from a roll sheet feeding unit, and a determination unit configured to determine the feeding unit that feeds the sheet to the recording unit. If the first detection unit detects that there is the sheet, the driving control unit drives the motor in a direction for rewinding the roll sheet, and the determination unit executes the determination processing for the feeding unit based on an output value associated with the driving of the motor.

28 Claims, 8 Drawing Sheets

FIG.6A

PLEASE LOAD SHEET

C: 100% M: 100% Y: 100% BK: 100%

UPPER-STAGE ROLL SHEET

LOWER-STAGE ROLL SHEET

CUT SHEET

MAINTENANCE

FIG.6B

READY TO PRINT

C: 100% M: 100% Y: 100% BK: 100%

UPPER-STAGE ROLL SHEET PLAIN PAPER

LOWER-STAGE ROLL SHEET

CUT SHEET

MAINTENANCE

FIG.6C

UPPER-STAGE ROLL SHEET

LOWER-STAGE ROLL SHEET PLAIN PAPER

CUT SHEET

FIG.6D

UPPER-STAGE ROLL SHEET

LOWER-STAGE ROLL SHEET

CUT SHEET PLAIN PAPER

FIG.6E

UPPER-STAGE ROLL SHEET PLAIN PAPER

LOWER-STAGE ROLL SHEET

CUT SHEET PLAIN PAPER

FIG.6F

UPPER-STAGE ROLL SHEET PLAIN PAPER

LOWER-STAGE ROLL SHEET PLAIN PAPER

CUT SHEET PLAIN PAPER

FIG.6G

UPPER-STAGE ROLL SHEET PLAIN PAPER

LOWER-STAGE ROLL SHEET PLAIN PAPER

CUT SHEET

FIG.6H

UPPER-STAGE ROLL SHEET PLAIN PAPER

LOWER-STAGE ROLL SHEET PLAIN PAPER

CUT SHEET

RECORDING APPARATUS, AND METHOD FOR CONTROLLING RECORDING APPARATUS

BACKGROUND OF THE INVENTION

Field of the Invention

The present invention relates to a recording apparatus on which a plurality of types of sheets, such as a cut sheet and a roll sheet, can be loaded.

Description of the Related Art

Some printers are capable of printing data on both a roll sheet and a cut sheet, and such a printer has an operation mode for the roll sheet and an operation mode for the cut sheet. Conventionally, the operation mode for the roll sheet and the operation mode for the cut sheet have been switched based on a user's selection of a switching button on an operation panel. Therefore, a problem has arisen when the user has loaded the roll sheet although having selected the operation mode for the cut sheet, or when the user has loaded the cut sheet although having selected the operation mode for the roll sheet.

To solve this problem, Japanese Patent Application Laid-Open No. 2012-139998 proposes a method for distinguishing between the roll sheet and the cut sheet and automatically setting an appropriate operation mode. More specifically, a printer includes conveying rollers that convey both the roll sheet and the cut sheet, a roll-sheet conveying unit that rotationally conveys the roll sheet, and a sensor that detects whether there is a sheet on a downstream side of the conveying rollers. Then, the printer rotates the roll sheet in a direction for rewinding the roll sheet with use of the above-described conveying unit, and detects whether the detection of the sensor on the downstream side of the conveying rollers changes to absence of the sheet. After the sheet is detected by a detecting unit, the printer causes the roll-sheet conveying unit to perform the conveyance operation, and, after that, determines that the loaded sheet is the cut sheet if the sheet is detected again by the detecting unit while determining that the loaded sheet is the roll sheet if the sheet is not detected by the detecting unit.

However, the method discussed in Japanese Patent Application Laid-Open No. 2012-139998 not only requires the sensor on the downstream side of the conveying rollers but also requires a driving unit such as a motor for automatically separating the conveying rollers from each other when rewinding the sheet by the roll-sheet conveying unit, a sensor for detecting a position, and the like, thereby resulting in a cost increase. Further, in a case where the printer is a printer that supports various sheet sizes including 10 inches to 60 inches, such as a large-format printer, a weight of the sheet considerably varies depending on a width and a length of the sheet. Therefore, an attempt to rewind the sheet without separating the conveyance rollers from each other leads to such a nip pressure that merely rewinding the roll sheet triggers a rotation, which results in a reduction in a performance of conveying the sheet in a normal case.

Further, if the winding of the roll sheet is loosened or the roll sheet is unwound at an end of the roll sheet, the printer incorrectly determines that the loaded sheet is the cut sheet. Therefore, this method involves a problem of being unable to set the appropriate operation mode.

Further, in a case where the printer includes a plurality of roll sheet feeding units, which sheet feeding unit feeds the roll sheet may be unable to be determined depending on a position of a leading edge of the roll sheet. This case leads to a problem of being unable to drive an appropriate driving unit for a sheet feeding operation.

SUMMARY OF THE INVENTION

According to an aspect of the present invention, a recording apparatus includes a plurality of feeding units each configured to feed a sheet, a conveyance unit provided in a vicinity of a recording unit and configured to convey the sheet to this recording unit, a first detection unit provided on an upstream side of the recording unit in a direction in which the sheet is conveyed and configured to detect whether there is the sheet, a driving control unit configured to control driving of a motor for conveying a roll sheet fed from a roll sheet feeding unit between or among the plurality of feeding units, and a determination unit configured to determine the feeding unit that feeds the sheet to the recording unit between or among the plurality of feeding units. If the first detection unit detects that there is the sheet, the driving control unit drives the motor in a direction for rewinding the roll sheet with the sheet fixed by the conveyance unit, and the determination unit determines the feeding unit that feeds the sheet to the recording unit based on an output value associated with the driving of the motor.

Further features of the present invention will become apparent from the following description of exemplary embodiments with reference to the attached drawings.

BRIEF DESCRIPTION OF THE DRAWINGS

FIGS. 6A, 6B, 6C, 6D, 6E, 6F, 6G, and 6H are each one example of a view of a part of a screen on an operation panel of the recording apparatus according to the first exemplary embodiment.

DESCRIPTION OF THE EMBODIMENTS

In the following description, exemplary embodiments of the present invention will be described with reference to the drawings.

Figure 1A:
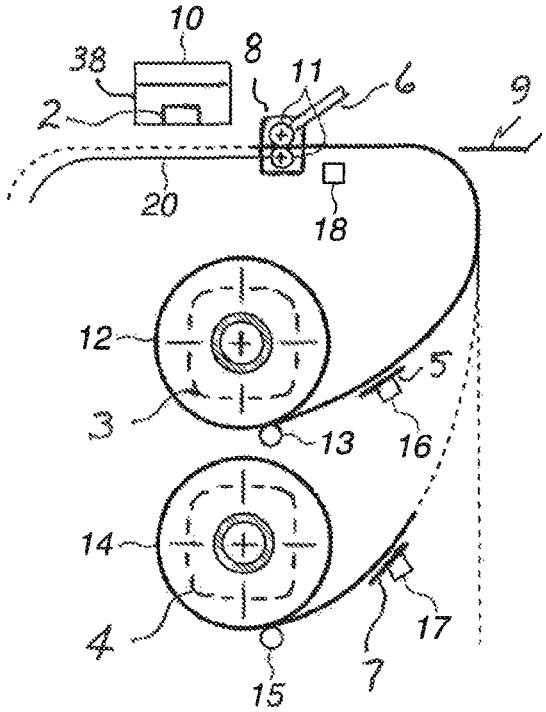
FIGS. 1A and 1B are each one example of a side view of a recording apparatus according to a first exemplary embodiment.
Figure 1B:
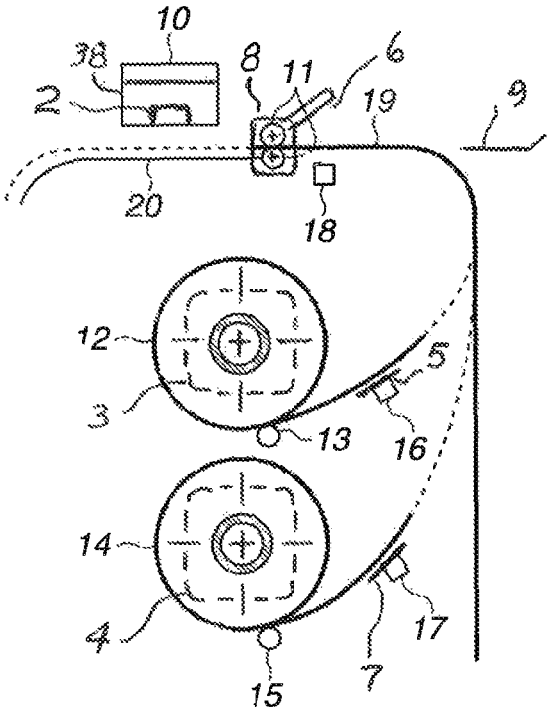

FIGS. 1A and 1B each illustrate a side surface of a main portion of an inkjet recording apparatus according to a first exemplary embodiment of the present invention.

The inkjet recording apparatus includes an inkjet-type image forming unit (also referred to as a recording unit), a conveyance unit, a feeding unit that feeds a sheet, and a main body control unit (not illustrated). The image forming unit includes a carriage 10 on which an inkjet-type recording head is mounted. The carriage 10 scans from a front side to a back side in FIG. 1. At the same time as this main scanning, a sheet (paper) is conveyed in a sub scanning direction (a leftward direction in FIG. 1) on a platen 20, and ink is discharged from a recording head 2, by which an image is formed on the sheet. The carriage 10 is configured to be able to detect a position with an encoder mounted thereon. The sheet described here may be any of a cut sheet and a roll sheet. In the present example shown in FIGS. 1A-B, a unit including the recording head 2 and the carriage 10 serves as the recording unit.

Conveyance rollers 11 are provided on a common conveyance path, and a plurality of types of sheets that will be described below are conveyed to the common conveyance path by the conveyance rollers 11. An optical reflective sensor 18 is provided in the vicinity of the conveyance rollers 11 on the common conveyance path, as a detection unit that detects the sheet. The sensor 18 (hereinafter also referred to as a platen sensor) functions to optically detect presence or absence of the sheet conveyed to the common conveyance path.

The feeding unit, which feeds the sheet, includes a sheet feeding unit 12 (an upper-stage feeding unit) and a sheet feeding unit 14 (a lower-stage feeding unit), each of which feeds the sheet for use in printing. A roll sheet formed by winding a long band-like sheet into a roll shape is loaded on each of the sheet feeding units 12 and 14. Hereinafter, the sheet loaded on the sheet feeding unit 12 will be referred to as an "upper-stage roll sheet". Hereinafter, the sheet loaded on the sheet feeding unit 14 will be referred to as a "lower-stage roll sheet". Further, the cut sheet can be fed on the recording apparatus. The cut sheet can be fed on the platen 20 by, for example, a user's setting the cut sheet on a manual sheet feeding port 9 provided on an upper surface of a main body of the recording apparatus. The manual sheet feeding port may be provided on a downstream side of the recording unit, or may be provided on an upstream side of the recording unit. In FIG. 1A, the upper-stage roll sheet and the lower-stage roll sheet are loaded on the sheet feeding units 12 and 14, respectively, and the lower-stage roll sheet is in a retracted state. The present exemplary embodiment will be described, assuming that the upstream side and the downstream side are a sheet feeding unit side and an image forming unit side, respectively. A roller 13 provided under the sheet feeding unit 12 sandwiches the upper-stage roll sheet. A driving motor 3 is mounted on a shaft of the sheet feeding unit 12, and a rotation of this roller causes the upper-stage roll sheet to be rotated around the shaft. This operation allows the upper-stage roll sheet to be conveyed in any of an upstream direction and a downstream direction. When rewinding the sheet, the recording apparatus performs an operation of rotating the roll sheet in a clockwise direction as viewed in FIG. 1 to remove slack of the sheet. A roller 15 provided under the sheet feeding unit 14 sandwiches the lower-stage roll sheet. A driving motor 4 is also mounted on a shaft of the sheet feeding unit 14, and a rotation of this roller causes the lower-stage roll sheet to be rotated around the shaft. This operation allows the lower-stage roll sheet to be conveyed in any of the upstream direction and the downstream direction. When rewinding the sheet, the recording apparatus performs an operation of rotating the roll sheet in the clockwise direction as viewed in FIG. 1 to remove slack of the sheet. The upper-stage roll sheet is held by being vertically sandwiched by the conveyance rollers 11. These conveyance rollers 11 can be rotated by a driving motor/respective driving motors 8. The rotations of these conveyance rollers 11 can convey the upper-stage roll sheet to the left and the right of the conveyance rollers 11. Further, an encoder/respective encoders is/are provided between the driving motor/the respective driving motors 8 and the conveyance rollers 11, and a position of the sheet can be managed by detecting the actual rotations.

The platen 20 is provided under the sheet on the downstream side of the conveyance rollers 11, and the sheet is sucked onto the platen 20 by being sucked from a suction port of the platen 20, thereby being prevented from floating during the printing.

Now, being loaded on the platen 20 is defined to mean that the sheet is loaded on (or above) a conveyance surface (more specifically, the platen 20) facing the recording unit including a head unit 38 while being sandwiched by the conveyance rollers 11. Further, being retracted is defined to mean a state in which the sheet is located on the upstream side of the conveyance rollers 11 and the sensor 18, like the lower-stage roll sheet.

A sensor is provided on a sheet feeding port portion of each of the sheet feeding units 12 and 14, as a detection unit that detects presence or absence of the sheet. A sensor 16 provided on the sheet feeding port portion 5 of the sheet feeding unit 12 (hereinafter also referred to as an upper-stage sheet feeding port sensor) detects whether there is the sheet on the upper-stage sheet feeding port portion 5. Further, a sensor 17 provided on the sheet feeding port portion 7 of the sheet feeding unit 14 (hereinafter also referred to as a lower-stage sheet feeding port sensor) detects whether there is the sheet on the lower-stage sheet feeding port portion 7.

When the sheet is fed in a waiting state, the control unit 30 displays an inquiry about whether to feed the sheet on an operation panel 32 of the recording apparatus at the moment when at least one of the sensor 16 and the sensor 17 detects change from the absence of the sheet to the presence of the sheet. Upon detecting that an OK key is pressed on the operation panel 32, the control unit automatically conveys the sheet to the conveyance rollers 11, and, after that, performs a sheet feeding operation, such as detection of an edge of the sheet. If the sensor 16 detects change from the absence of the sheet to the presence of the sheet, this detection allows the control unit to determine that paper (the sheet) has been loaded on the sheet feeding unit 12, thereby allowing the control unit to cause the recording apparatus to operate assuming that the sheet has been loaded on the upper-stage feeding unit 12. If the upper-stage roll sheet is loaded on the sheet feeding unit 12 with the lower-stage roll sheet already loaded on the platen 20, i.e., the lower-stage roll sheet sandwiched by the conveyance rollers 11, the recording apparatus conveys the upper-stage roll sheet to the conveyance rollers 11 after retracting the lower-stage roll sheet to a retraction position as illustrated in FIG. 1A. Similarly, if the sensor 17 detects change from the absence of the sheet to the presence of the sheet, this detection allows the control unit to determine that the sheet has been loaded on the sheet feeding unit 14, thereby allowing the control unit to cause the recording apparatus to operate assuming that the sheet has been loaded on the lower-stage feeding unit 14.

In the present exemplary embodiment, the sensors 16 and 17 are provided on the upper-stage sheet feeding port portion and the lower-stage sheet feeding port portion, respectively, for automatic sheet feeding. In a case where the recording apparatus supports only manual sheet feeding, which will be described below, the sensors 16 and 17 on the sheet feeding port portions may be omitted.

In FIG. 1B, the cut sheet is loaded on the platen 20, and the upper-stage roll sheet and the lower-stage roll sheet are in the retracted state.

The conveyance rollers 11 are connected to a release lever 6, and the user's opening and closing the lever displaces an upper-side roller of the pair of conveyance rollers 11 upwardly in the drawings, thereby switching the conveyance rollers 11 from a state sandwiching the sheet therebetween to an opened separated state. To feed the cut sheet, the user opens the release lever 6 and inserts the sheet with the pair of conveyance rollers 11 separated from each other, and closes the release lever 6 to thereby close the conveyance rollers 11. As a result, the cut sheet is loaded on the platen 20. The user can also manually load the upper-stage roll sheet or the lower-stage roll sheet by opening the release lever 6. This loading method is defined to be the manual sheet feeding.

Between FIGS. 1A and 1B, each of the sensors (the sensor 16, the sensor 17, and the sensor 18) indicate a same state, i.e., the presence of the sheet, despite a difference between respective sheet feeding states in FIGS. 1A and 1B. Therefore, after the release lever is closed, which sheet has been loaded on the platen 20 cannot be determined. In other words, each of the sensors 16, 17, and 18 outputs a same determination result between a state in which the upper-stage roll sheet has been loaded on the platen 20 and a state in which the cut sheet has been loaded on the platen 20. Further, each of the sensors 16, 17, and 18 also outputs a same determination result between a state in which the lower-stage roll sheet has been loaded on the platen 20 and the state in which the cut sheet has been loaded on the platen 20. In the present exemplary embodiment, the recording apparatus can determine which sheet is sandwiched by the conveyance rollers 11, the upper-stage roll sheet, the lower-stage roll sheet, or the cut sheet. In the present exemplary embodiment, the recording apparatus is being described as including the lower-stage sheet feeding unit 14, but is not limited thereto and can make the determination by a similar method even without including the lower-stage sheet feeding unit 14.

Figure 2:
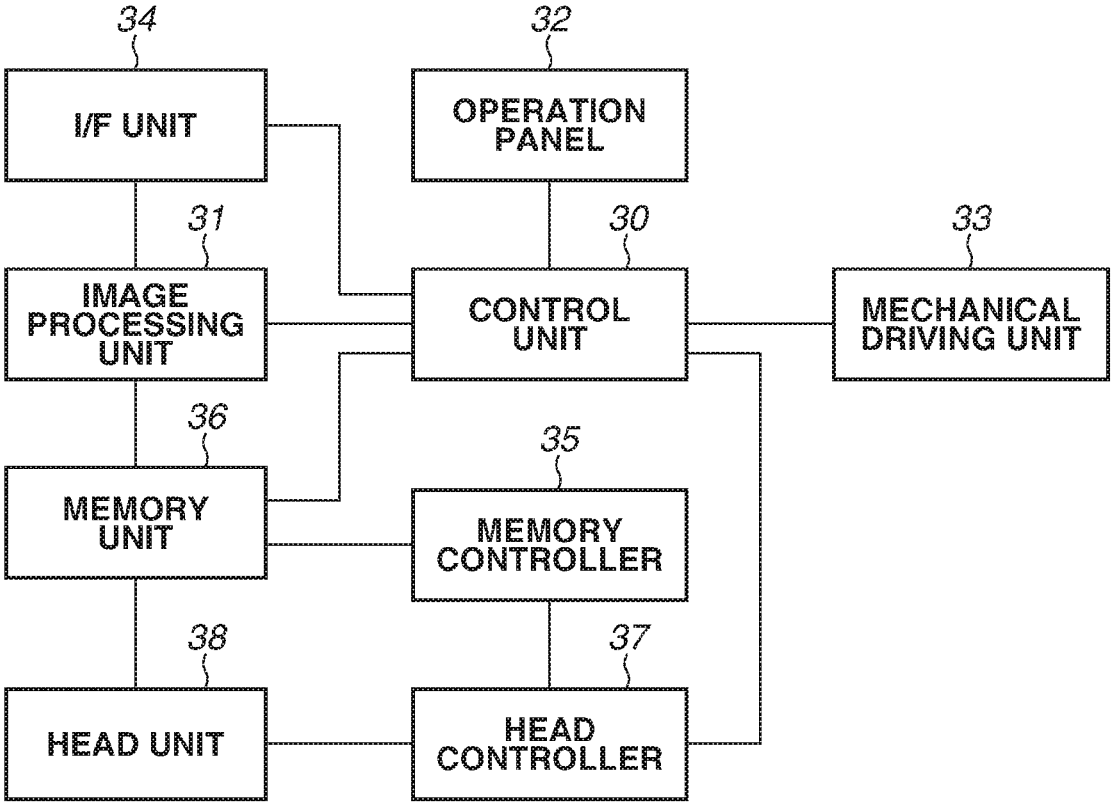
FIG. 2 is one example of a block diagram illustrating a configuration of the recording apparatus according to the first exemplary embodiment.

FIG. 2 is a block diagram illustrating a configuration of the recording apparatus according to the present exemplary embodiment. A control unit 30 controls the entire recording apparatus. For example, the control unit 30 controls driving of motors that will be described below. In the present exemplary embodiment, a central processing unit (CPU) is assumed to operate as the control unit 30.

An interface (I/F) unit 34 can be connected to a host computer (not illustrated). The I/F unit 34 receives a command and recording data to be printed from the host computer, and the recording apparatus operates according to this command, thereby recording the recording data onto the sheet. Further, the recording apparatus can notify the host computer of a state of the recording apparatus by transmitting information about the recording apparatus to the host computer as a command and data via the I/F unit 34. This notification also allows the recording apparatus to notify the user of sheet information. For example, a Centronics interface and a Universal Serial Bus (USB) interface can be used as the I/F unit 34.

An image processing unit 31 performs a gamma correction, color processing, enlargement/reduction processing, binarization, and the like regarding the recording data (multivalued image data) transmitted from the I/F unit 34. The image processing unit 31 includes, for example, a memory, an application specific integrated circuit (ASIC), a digital signal processor (DSP), a reduced instruction set computer (RISC) chip, and/or the like. This image processing unit 31 may be held by a driver or a raster image processor (RIP) on the host side. Data (print data) developed into a dot pattern by the processing performed by the image processing unit 31 is temporarily accumulated in a memory unit 36.

The memory unit 36 includes a memory capable of storing data corresponding to one band or more, which is necessary for the carriage 10 to record the data by scanning once in a main scanning direction. Further, the memory unit 36 is also used to store image information of an image, and information about the main body such as the position of the roll sheet and a value for correcting a cutting position, which are used at the time of the printing. The memory unit 36 includes, for example, a read only memory (ROM) and a random access memory (RAM). The ROM stores a program to be executed by the CPU, and fixed data necessary for various kinds of operations of the recording apparatus. The RAM is used as a work area by the CPU, is used as an area for temporarily storing various kinds of received data, and stores various kinds of setting data.

A memory controller 35 writes/reads the print data into/from the memory unit 36 under control by the DSP and/or the RISC chip of the image processing unit 31. The memory controller 35 generates an address signal and a writing/reading timing signal, and outputs the generated signals to the memory unit 36. The print data read out from the memory unit 36 is output to a head controller 37 in synchronization with a reading signal from the head controller 37.

The head controller 37 generate a timing signal regarding a discharge of ink and a heat pulse at the head unit 38 according to control by the control unit 30 based on a signal from a linear scale (not illustrated).

The head unit 38 includes the recording head 2 corresponding to the ink of each color, and records the image onto a sheet surface by heating a heater unit and discharging the ink by the control unit 30 and the head controller 37. The head unit 38 is mounted on the carriage 10 of a mechanical driving unit 33.

The mechanical driving unit 33 includes a carriage unit for displacing the recording head 2 in the main scanning direction, a sheet control unit for causing a carriage driving unit and the recording sheet to move, and a recovery unit for recovering a clog of the ink at the recording head 2, and, besides them, an encoder and a sensor.

Further, although not illustrated, a sensor unit, which detects the edge of the sheet and a print position in which print is performed by a specific nozzle, is mounted on the carriage 10.

After the sensor is placed above the sheet by a displacement of the carriage unit, the sheet is rewound. At this time, the sensor acquires positional information of the edge of the sheet such as positional information of a leading edge by calculating a position where the sensor starts detecting the absence of the sheet based on a signal/respective signals of the encoder/the encoders associated with the conveyance rollers 11, as the position of the leading edge of the sheet. Further, similarly, the sensor acquires positional information such as information indicating a printing position and an edge of the sheet in the carriage direction based on a signal of the encoder when the sensor mounted on the carriage changes, by moving the carriage 10 without moving the sheet. The sheet information such as these calculated positions and detected information is stored in the memory unit 36. When the cut sheet is loaded on the platen 20, the recording apparatus conveys the sheet toward the downstream side and detects a trailing edge of the sheet with use of the sensor 18, and, after that, conveys the sheet toward the upstream side and detects the position of the leading edge of the sheet with use of the sensor unit on the carriage 10. By this operation, the recording apparatus can measure a length of the sheet. Then, the recording apparatus completes the sheet feeding operation by moving the leading edge of the sheet to a waiting position that is located a predetermined distance downstream from the conveyance rollers 11 (for example, 5 mm downstream from the conveyance rollers 11).

The sheet feeding operation according to the present exemplary embodiment has been described referring to one example thereof, but is not limited thereto. For example, the recording apparatus may cause the user to load the sheet at the position located 5 mm downstream from the conveyance rollers 11 as a loading position, and perform the sheet feeding operation with a determination that this position is the position of the leading edge of the sheet, without detecting the edge of the sheet.

An operation panel 32 is a display unit where the user can input an operation, and displays a key, which is one type of switch, and the state of the recording apparatus. The operation panel 32 displays a picture, a character, and the like on a display screen, and monitors the key, under display control by the control unit 30. The user can confirm the state of the recording apparatus and instructs the recording apparatus to perform processing by operating the key while viewing the display screen.

Now, a method for determining the type of the sheet will be described with reference to a table 1. The table 1 is a truth table indicating a result of the determination made by each of the sensors 16, 17, and 18 and a determination about a sheet state. In the table 1, "Sheet Detected" indicates that the sensor 16, 17, or 18 detects the presence of the sheet, and "Sheet Undetected" indicates that the sensor 16, 17, or 18 detects the absence of the sheet.

TABLE 1

| Result of Determination Made by Platen Sensor | Result of Determination Made by Upper-stage Sheet Feeding Port Sensor | Result of Determination Made by Lower-stage Sheet Feeding Port Sensor | Sheet State |
|---|---|---|---|
| Sheet Undetected | Sheet Undetected | Sheet Undetected | No Sheet Fed |
| Sheet Undetected | Sheet Undetected | Sheet Detected | Lower-stage Roll Sheet Retracted |
| Sheet Undetected | Sheet Detected | Sheet Undetected | Upper-stage Roll Sheet Retracted |
| Sheet Undetected | Sheet Detected | Sheet Detected | Upper-stage Roll Sheet Retracted and Lower-stage Roll Sheet Retracted |
| Sheet Detected | Sheet Undetected | Sheet Undetected | Cut Sheet Loaded |
| Sheet Detected | Sheet Undetected | Sheet Detected | (1) Lower-stage Roll Sheet Loaded (2) Cut Sheet Loaded and Lower-stage Roll Sheet Retracted |
| Sheet Detected | Sheet Detected | Sheet Undetected | (1) Upper-stage Roll Sheet Loaded (2) Cut Sheet Loaded and Upper-stage Roll Sheet Retracted |
| Sheet Detected | Sheet Detected | Sheet Detected | (1) Cut Sheet Loaded and Upper-stage and Lower-stage Roll Sheets Retracted (2) Upper-stage Roll Sheet Loaded and Lower-stage Roll Sheet Retracted (3) Lower-stage Roll Sheet Loaded and Upper-stage Roll Sheet Retracted |

First, the recording apparatus makes the determination as far as determinable from the result of the detection carried out by each of the sensors 16, 17, and 18.

If none of the platen sensor (the sensor 18), the upper-stage sheet feeding port sensor (the sensor 16), and the lower-stage sheet feeding port sensor (the sensor 17) detects the presence of the sheet, the recording apparatus determines that none of the sheets is loaded and the present state is a state in which no sheet is fed.

If the platen sensor 18 and the upper-stage sheet feeding port sensor 16 do not detect the presence of the sheet (detect the absence of the sheet) and only the lower-stage sheet feeding port sensor 17 detects the presence of the sheet, the recording apparatus determines that the lower-stage roll sheet is in the retracted state. Further, at this time, since there is no sheet on the platen 20, the recording apparatus determines that no sheet is loaded on the platen 20. In this case, assume that the recording apparatus determines that no sheet is loaded on the platen 20 if the lower-stage roll sheet is in the retracted state.

If the platen sensor 18 and the lower-stage sheet feeding port sensor 17 do not detect the presence of the sheet (detect the absence of the sheet) and the upper-stage sheet feeding port sensor 16 detects the presence of the sheet, this makes certain that the upper-stage roll sheet is in the retracted state, whereby the recording apparatus determines that the upper-stage roll sheet is in the retracted state. At this time, since there is no sheet on the platen 20, the recording apparatus determines that no sheet is loaded on the platen 20.

If the platen sensor 18 does not detect the presence of the sheet (detects the absence of the sheet) and both the upper-stage sheet feeding port sensor 16 and the lower-stage sheet feeding port sensor 17 detect the presence of the sheet, this makes certain that each of the upper-stage roll sheet and the lower-stage roll sheet is in the retracted state, whereby the recording apparatus determines that both the upper-stage roll sheet and the lower-stage roll sheet are in the retracted state.

If the platen sensor 18 detects the presence of the sheet and the upper-stage sheet feeding port sensor 16 and the lower-stage sheet feeding port sensor 17 detect the absence of the sheet, this makes certain that the roll sheets are absent, whereby the recording apparatus determines that the cut sheet is loaded.

The cases described so far are examples of results determinable only from the sensors 16, 17, and 18. The cases that will be described from now are examples of results undeterminable only from the detection about the presence or the absence of the sheet by the sensors 16, 17, and 18.

If the platen sensor 18 and the lower-stage sheet feeding port sensor 17 detect the presence of the sheet and the upper-stage sheet feeding port sensor 16 detects the absence of the sheet, the recording apparatus can determine that the sheet loaded on the platen 20 is not the upper-stage roll sheet. However, the recording apparatus cannot distinguish whether the lower-stage roll sheet is loaded, or the cut sheet is loaded and the lower-stage roll sheet is in the retracted state. Similarly, if the platen sensor 18 and the upper-stage sheet feeding port sensor 16 detect the presence of the sheet and the lower-stage sheet feeding port sensor 17 detects the absence of the sheet, the recording apparatus can determine that the sheet loaded on the platen 20 is not the lower-stage roll sheet. However, the recording apparatus cannot distinguish (determine) whether the upper-stage roll sheet is loaded, or the cut sheet is loaded and the upper-stage roll sheet is in the retracted state. In both the cases illustrated in FIGS. 1A and 1B, the sensor 18 and the sensor 16 detect the presence of the sheet. Further, if all of the platen sensor 18, the upper-stage sheet feeding port sensor 16, and the lower-stage sheet feeding port sensor 17 detect the presence of the sheet, the recording apparatus cannot distinguish whether the cut sheet is loaded on the platen 20 and the upper-stage roll sheet and the lower-stage roll sheet are in the retracted state, the upper-stage roll sheet is loaded on the platen 20 and the lower-stage roll sheet is in the retracted state, or the lower-stage roll sheet is loaded on the platen 20 and the upper-stage roll sheet is in the retracted state. When being unable to correctly determine the state only from the sensors 16, 17, and 18, like these cases, the recording apparatus performs determination processing according to a flowchart that will be described below with reference to FIG. 4.

Further, in a case where the recording apparatus does not include the upper-stage sheet feeding port sensor 16 and the lower-stage sheet feeding port sensor 17, the recording apparatus can distinguish only between the state in which no sheet is fed, and a state other than that (the state in which any of the upper-stage roll sheet, the lower-stage roll sheet, and the cut sheet is set on the platen 20). However, even in this case, the recording apparatus can determine the type of the sheet set on the platen 20 (a source that feeds the sheet) by performing similar processing. More specifically, if the sheet feeding state is a state other than the state in which no sheet is fed, this case is handled in a similar manner to the case listed at a bottom of the table 1.

Figure 3:
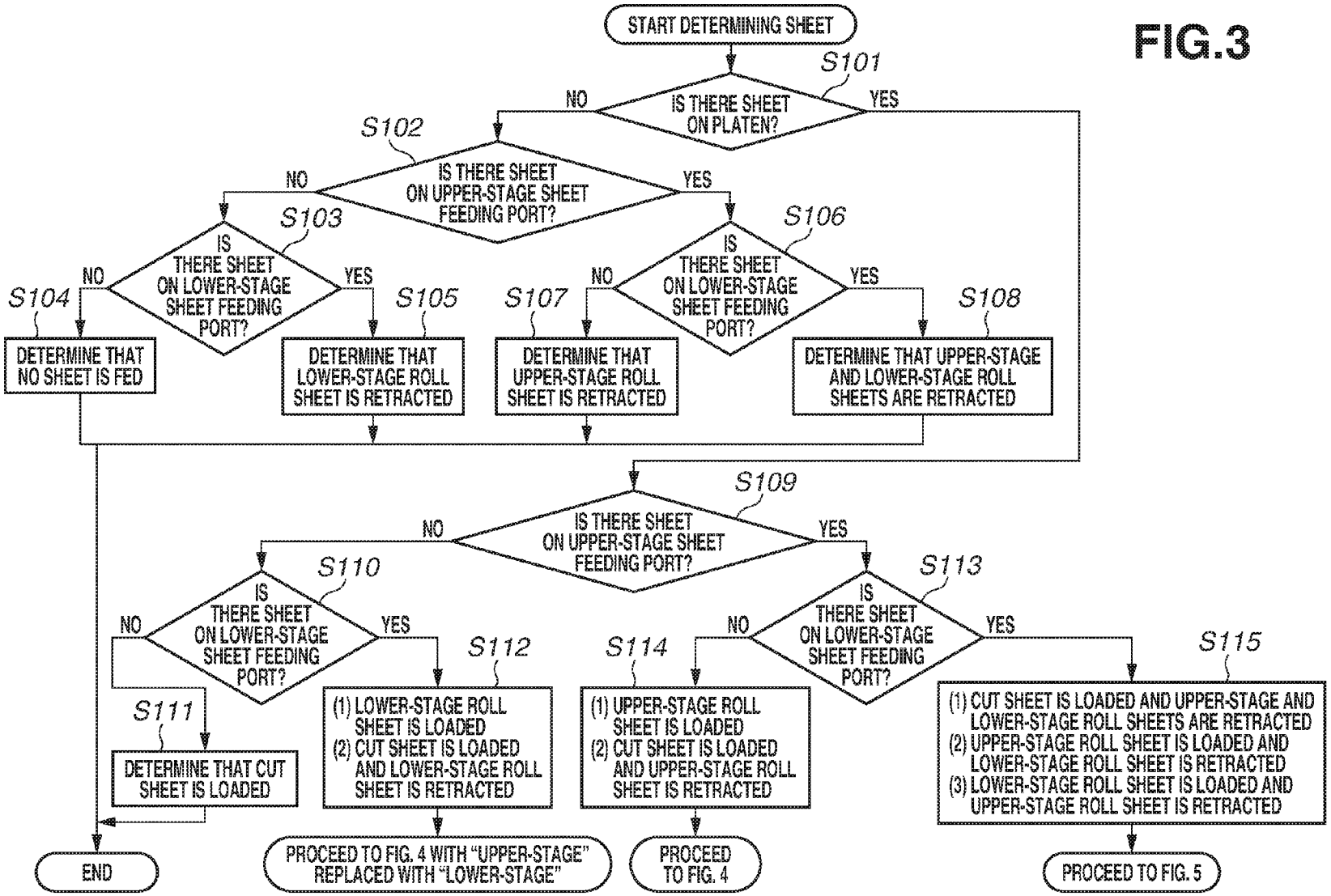
FIG. 3 is a flowchart of the recording apparatus according to the first exemplary embodiment.

FIG. 3 illustrates a flowchart for determining the sheet on the platen 20. This flowchart illustrates a flow of processing performed by the control unit 30 (the CPU) loading the control program stored in the ROM of the memory unit 36 into the RAM and executing this program.

The processing for determining the fed sheet is started when the user opens the release lever and loads the sheet. In the present exemplary embodiment, this processing is also started when the recording apparatus is powered on or returns from sleep. Even if the release lever is opened and the sheet is loaded while the recording apparatus is powered off, the recording apparatus can identify that when being powered on, by performing the determination processing when being powered on. Further, even if the release lever is opened and the sheet is loaded while the recording apparatus is sleeping, the recording apparatus can identify that by performing the determination processing when returning from the sleep. In the present exemplary embodiment, the recording apparatus can detect that the release lever is opened while being sleeping, and therefore performs the determination processing when returning from the sleep during which the release lever is opened. However, in a case where the recording apparatus is configured to be unable to detect that the release lever is opened while being sleeping, the same effect can be achieved by configuring the recording apparatus to always perform the determination processing when returning from sleep.

Upon the start of the processing for determining the sheet feeding state, in step S101, the recording apparatus determines whether there is the sheet on the platen 20 with use of the platen sensor 18.

If there is no sheet on the platen 20 (NO in step S101), in step S102, the recording apparatus determines whether there is the sheet on the upper-stage sheet feeding port with use of the upper-stage sheet feeding port sensor 16.

If the recording apparatus determines that there is no sheet on the upper-stage sheet feeding port (NO in step S102), in step S103, the recording apparatus determines whether there is the sheet on the lower-stage sheet feeding port with use of the lower-stage sheet feeding port sensor 17. If the recording apparatus determines that there is no sheet on the lower-stage sheet feeding port (NO in step S103), in step S104, the recording apparatus determines that the present sheet feeding state is the state in which no sheet is fed since all of the sensors 16, 17, and 18 determine that there is no sheet. In other words, the recording apparatus determines that no sheet is loaded on the platen 20. Then, the processing is ended. If the recording apparatus detects that there is the sheet on the lower-stage sheet feeding port (YES in step S103), in step S105, the recording apparatus determines that the lower-stage roll sheet is in the retracted state and also determines that no sheet is loaded on the platen 20 since there is the sheet only on the lower-stage sheet feeding port. Then, the processing is ended.

If there is the sheet on the upper-stage sheet feeding port (YES in step S102), in step S106, the recording apparatus determines whether there is the sheet on the lower-stage sheet feeding port with use of the lower-stage sheet feeding port sensor 17. If the recording apparatus determines that there is no sheet on the lower-stage sheet feeding port (NO in step S106), in step S107, the recording apparatus determines that the upper-stage roll sheet is in the retracted state and also determines that no sheet is loaded on the platen 20 since there is the sheet only on the upper-stage sheet feeding port. Then, the processing is ended. If the recording apparatus determines that there is the sheet on the lower-stage sheet feeding port (YES in step S106), this means that there is the sheet on each of the upper-stage sheet feeding port and the lower-stage sheet feeding port. Therefore, in step S108, the recording apparatus determines that the upper-stage roll sheet is in the retracted state and the lower-stage roll sheet is also in the retracted sate, and determines that no sheet is loaded on the platen 20. Then, the processing is ended. Steps S102 to S108 are steps performed when there is no sheet on the platen 20, and the advancement to these steps basically means that no sheet is manually loaded by the user.

If the recording apparatus determines that there is the sheet on the platen 20 (YES in step S101), this can lead to a determination that the present sheet feeding state is a state in which some sheet is loaded by the user. The processing proceeds to step S109, in which the recording apparatus determines whether there is the sheet on the upper-stage sheet feeding port with use of the upper-stage sheet feeding port sensor 16. If there is no sheet on the upper-stage sheet feeding port (NO in step S109), in step S110, the recording apparatus determines whether there is the sheet on the lower-stage sheet feeding port with use of the lower-stage sheet feeding port sensor 17. If the recording apparatus determines that there is no sheet on the lower-stage sheet feeding port (NO in step S110), in step S111, the recording apparatus determines that the loaded sheet is the cut sheet since there is the sheet only on the platen 20 and there is no sheet on each of the upper-stage sheet feeding port and the lower-stage sheet feeding port.

The flow of the processing described so far is the flow when the recording apparatus can be determined which sheet is loaded on the platen 20 only from the sensors 16, 17, and 18.

If the recording apparatus determines that there is the sheet on the lower-stage feeding port in step S110 (YES in step S110), in step S112, the recording apparatus determines that the present sheet feeding state is any of two states, (1) a state which the lower-stage roll sheet is loaded and (2) a state in which the cut sheet is loaded and the lower-stage roll sheet is in the retracted state, since there is the sheet on each of the platen 20 and the lower-stage sheet feeding port. Then, the recording apparatus determines which state the present sheet feeding state is by performing the determination processing illustrated in FIG. 4 that will be described below, in which the term "upper-stage" is replaced with the term "lower-stage".

If the recording apparatus determines that there is the sheet on the upper-stage sheet feeding port in step S109 (YES in step S109), in step S113, the recording apparatus determines whether there is the sheet on the lower-stage sheet feeding port with use of the lower-stage sheet feeding port sensor 17. If there is no sheet on the lower-stage sheet feeding port (NO in step S113), instep S114, the recording apparatus determines that the present sheet feeding state is any of two states, (1) a state in which the upper-stage roll sheet is loaded and (2) a state in which the cut sheet is loaded and the upper-stage roll sheet is in the retracted state, since there is the sheet on each of the platen 20 and the upper-stage sheet feeding port. Then, the recording apparatus determines which state the present sheet feeding state is by performing the determination processing illustrated in FIG. 4.

If the recording apparatus determines that there is the sheet on the lower-stage sheet feeding port (YES in step S113), in step S115, the recording apparatus determines that the present sheet feeding state is any of the following three states, (1) a state in which the cut sheet is loaded and the upper-stage roll sheet and the lower-stage roll sheet are each retracted, (2) a state in which the upper-stage roll sheet is loaded and the lower-stage roll sheet is in the retracted state, and (3) a state in which the lower-stage roll sheet is loaded and the upper-stage roll sheet is in the retracted state, since there is the sheet on each of all the platen 20, the upper-stage sheet feeding port, and the lower-stage sheet feeding port. Then, the recording apparatus determines which state the present sheet feeding state is by performing determination processing illustrated in FIGS. 5A, 5B, and 5C.

Figure 4:
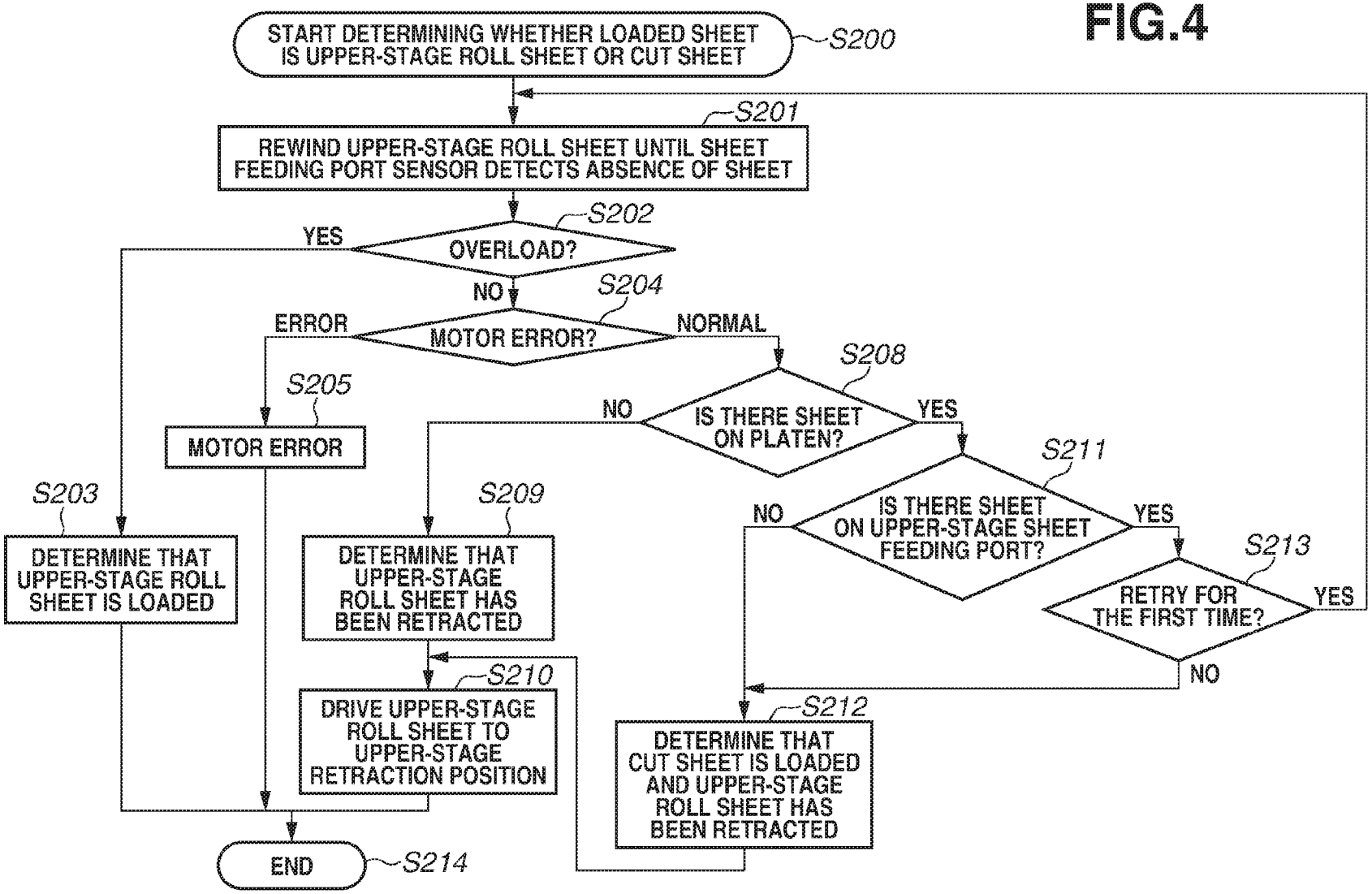
FIG. 4 is a flowchart illustrating a determination regarding which sheet is loaded that is made by the recording apparatus according to the first exemplary embodiment.

FIG. 4 is a flowchart illustrating the determination processing performed after step S114. In other words, FIG. 4 illustrates the determination processing for determining which sheet is loaded on the platen 20 in the present situation, the cut sheet or the upper-stage roll sheet. This flowchart illustrates a flow of processing performed by the control unit 30 (the CPU) loading the control program stored in the ROM of the memory unit 36 into the RAM and executing this program.

Replacing the term "upper-stage" in the flowchart illustrated in FIG. 4 with the term "lower-stage" allows this processing to be also used to determine which state the present sheet feeding state is between the two states, the state in which the lower-stage roll sheet is loaded and the state in which the cut sheet is loaded and the lower-stage roll sheet is in the retracted state.

After step S114, the recording apparatus starts determining whether the sheet loaded on the platen 20 is the upper-stage roll sheet or the cut sheet. First, in step S201, the recording apparatus rewinds the upper-stage roll sheet until the upper-stage sheet feeding port sensor (the sensor 16) determines the absence of the sheet. To rewind the upper-stage roll sheet, the recording apparatus performs a rewinding operation by rotating the upper-stage roll sheet contained in the sheet feeding unit 12 with use of the driving motor mounted on the shaft of the sheet feeding unit 12 with the conveyance rollers 11 kept stopped. At this time, the recording apparatus detects a current value of the motor. The detected current value is used to determine an overload in step S202. In the present exemplary embodiment, the rewinding operation has been described as the operation of rewinding the upper-stage roll sheet until the upper-stage sheet feeding port sensor 16 detects the absence of the sheet, but the recording apparatus may perform the rewinding operation by rewinding the upper-stage roll sheet until the platen sensor 18 detects the absence of the sheet similarly to an operation performed without use of the upper-stage sheet feeding port sensor 16. Alternatively, the recording apparatus may be configured to rewind the upper-stage roll sheet by a predetermined amount without referring to the change in the sensor 16 or 18.

Next, in step S202, the recording apparatus determines whether the driving motor for rotating the upper-stage roll sheet has been overloaded. A method for determining whether the motor is overloaded is not especially limited, but in the present exemplary embodiment, a threshold value is preset for the current value, and the recording apparatus gradually increases the current value when the motor does not reach a specified speed while being driven. When the current value exceeds the set threshold value, the recording apparatus determines that the motor is overloaded. The threshold value for the current value may be set to any value as long as this value is set appropriately according to the configuration, and may be set to an error threshold value for the current value that is set to detect a normal motor error, or a higher value than that, or may be set to a lower value than the error threshold value. This threshold value can be set to a lower value than the threshold value for the current value that is set to detect the normal motor error, and therefore is set to, for example, 500 mA in the present exemplary embodiment. In the present exemplary embodiment, the recording apparatus gradually increases the current value when the motor does not reach a speed of 75 mm/s, which is a target speed, while rewinding the sheet, and determines that the motor is overloaded at the moment when the current value thereof reaches 500 mA. In the present exemplary embodiment, the recording apparatus is configured to determine the overload based on the current value, but the determination of the overload is not limited thereto and the recording apparatus may be configured to determine the overload by measuring a voltage value or may determine the overload by another method. Further, in the present exemplary embodiment, the recording apparatus determines that the motor is overloaded at the moment when the current value reaches the threshold value, but the determination of the overload is not limited thereto and the recording apparatus may be configured to determine that the motor is overloaded when the current value is kept higher than the set threshold value for a certain predetermined time period.

If the recording apparatus has detected the overload, i.e., determines that the motor has been overloaded (YES in step S202), in step S203, the recording apparatus determines that the present sheet feeding state is the state in which the upper-stage roll sheet is fed on the platen 20. As illustrated in FIG. 1A, when the upper-stage roll sheet is loaded on the platen 20, the sheet is sandwiched by the conveyance rollers 11, so that an attempt to rewind the upper-stage roll sheet fails in rewinding the sheet as long as the conveyance rollers 11 is kept stopped, resulting in the detection of the overload. In other words, if the recording apparatus determines that the motor has been overloaded in step S202 (YES in step S202), in step S203, the recording apparatus can determine that the upper-stage roll sheet is loaded. Then, in step S214, the processing is ended. Normally, the overload is one type of motor error. However, in the present exemplary embodiment, the recording apparatus intentionally fixes the sheet loaded on the platen 20 by sandwiching the sheet between the conveyance rollers 11. Therefore, when the motor has been overloaded, the recording apparatus does not determine that the motor error has occurred, and identifies the sheet loaded on the platen 20.

On the other hand, if the recording apparatus has been unable to detect the overload, i.e., does not determine that the motor has been overloaded (NO in step S202), in step S204, the recording apparatus determines whether the motor error has occurred. If the motor is determined to have not been overloaded even when the driving roller for the upper-stage roll sheet has been driven, this means that the upper-stage roll sheet has been able to be rewound by the rewinding operation. In the present exemplary embodiment, when the motor has been overloaded, the recording apparatus does not determine that the error has occurred and first uses this overload to determine the sheet. The recording apparatus may be configured to determine the motor error or may be configured to end the processing without determining the motor error after that. In step S204, the recording apparatus determines whether the motor error has not occurred in another driving motor when having rewound the upper-stage roll sheet until the sensor 16 has detected the absence of the sheet.

If the motor error has occurred (ERROR in step S204), in step S205, the recording apparatus processes the motor error. In the present exemplary embodiment, the recording apparatus displays the motor error on the operation panel 32 of the main body, thereby notifying the user of the abnormality. Then, the recording apparatus presents a display prompting the user to power off the recording apparatus, and the determination processing is ended. This is because the motor error indicates that there is a problem with hardware.

If the motor error has not occurred (NORMAL in step S204), in step S208, the recording apparatus determines whether there is the sheet on the platen 20 with use of the platen sensor 18. The absence of the sheet on the platen 20 in step S208 leads to a deduction that the sheet originally located on the platen 20 has been the upper-stage roll sheet, and rewinding the upper-stage roll sheet has resulted in the absence of the sheet on the platen 20. Therefore, in step S209, the recording apparatus determines that the upper-stage roll sheet has been in the retracted state. In this case, in step S210, the recording apparatus determines that no sheet is loaded, and drives (actuates) the driving motor for the upper-stage roll sheet from the state in which the upper-stage sheet feeding port sensor 16 detects the absence of the sheet until the leading edge of the upper-stage roll sheet reaches a position located 10 mm downstream from a position where the upper-stage sheet feeding port sensor 16 detects the presence of the sheet. The state of the upper-stage roll sheet illustrated in FIG. 1B corresponds to the position located 10 mm downstream from the position where the upper-stage sheet feeding port sensor 16 detects the presence of the sheet.

If the recording apparatus determines that there is the sheet on the platen 20 (YES in step S208), in step S211, the recording apparatus determines whether there is the sheet on the upper-stage sheet feeding port with use of the upper-stage sheet feeding port sensor 16. If the upper-stage sheet feeding port sensor 16 detects the absence of the sheet (NO in step S211), this means that the cut sheet is fed on the platen 20 since the upper-stage roll sheet has been rewound. Therefore, in step S212, the recording apparatus determines that the cut sheet is loaded and the upper-stage roll sheet has been in the retracted state. Then, in step S210, the recording apparatus returns the leading edge of the upper-stage roll sheet to the retraction position similarly to when the processing proceeds to step S209, since the upper-stage roll sheet has been rewound as far as a position that has caused the upper-stage sheet feeding port sensor 16 to determine the absence of the sheet on the upper-stage sheet feeding port. Then, the processing is ended.

On the other hand, in step S211, the upper-stage sheet feeding port sensor 16 may detect the presence of the sheet (YES in step S211) despite the fact that the upper-stage roll sheet is supposed to have been rewound as far as the state in which the upper-stage sheet feeding port sensor 16 has detected the absence of the sheet in step S201. Examples of a situation creating such inconsistency include a situation where the upper-stage roll sheet has fluttered with sort of the winding thereof loosened, causing the upper-stage sheet feeding port sensor 16 to incorrectly detect the absence of the sheet. Therefore, the recording apparatus performs processing for retrying rewinding the upper-stage roll sheet only once. In step S213, the recording apparatus determines whether the retry processing is about to be performed for the first time. If the retry processing is about to be performed for the first time (YES in step S213), the processing returns to step S201 again, and is repeated. If the processing is repeated and proceeds to as far as step S213 again, since the retry processing is not about to be performed for the first time (NO in step S213) and the upper-stage sheet feeding port sensor 16 has detected the absence of the sheet when the upper-stage roll sheet has been rewound in step S201, in step S212, the recording apparatus determines that the cut sheet is fed on the platen 20 and the upper-stage roll sheet has been in the retracted state. Then, in step S210, the recording apparatus returns the leading edge of the upper-stage roll sheet to the retraction position. Then, the processing is ended.

Figure 5:
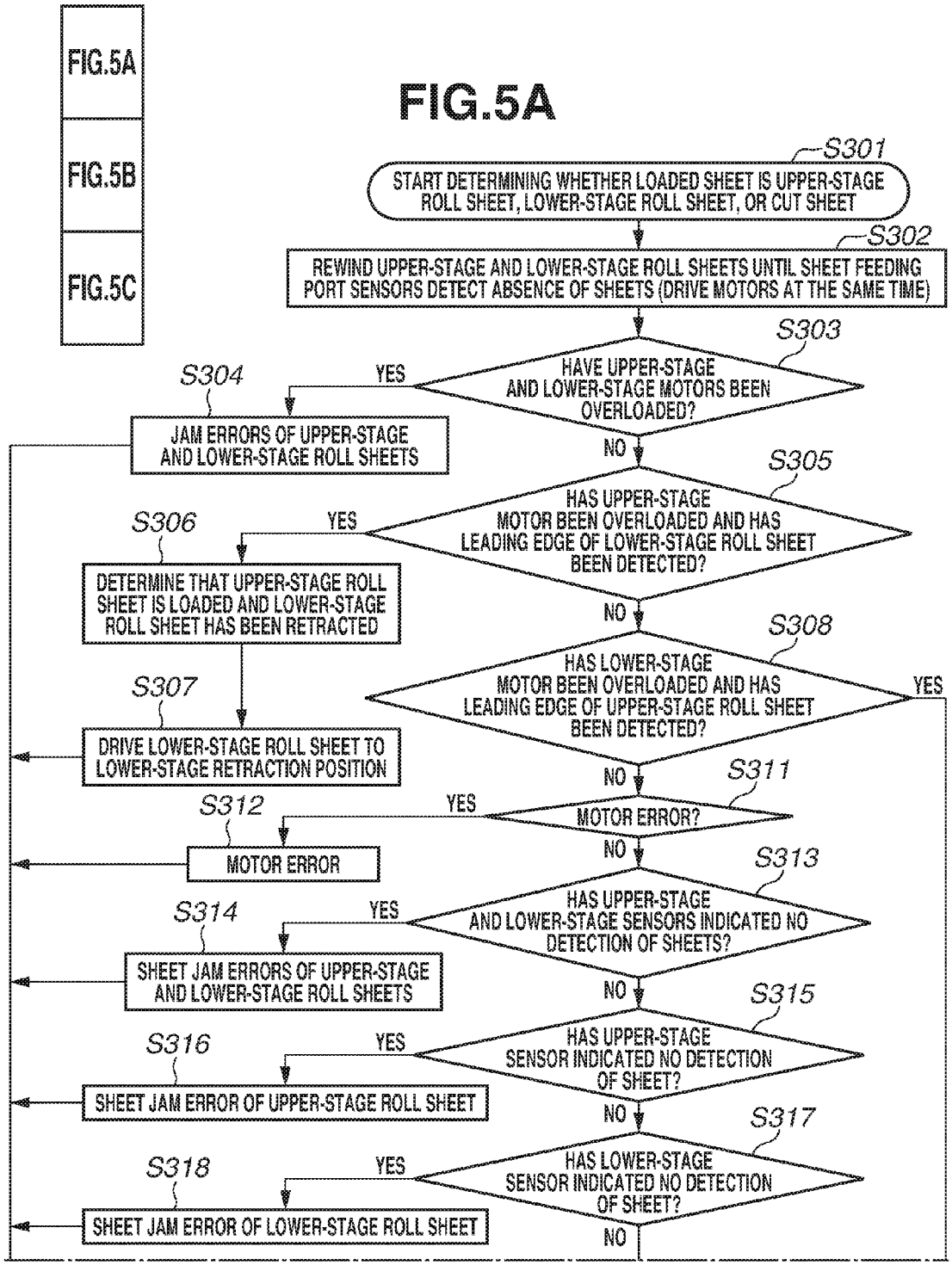
FIG. 5 comprising of FIGS. 5A, 5B, and 5C is a flowchart illustrating a determination made by the recording apparatus according to the first exemplary embodiment.
Figure 5B:
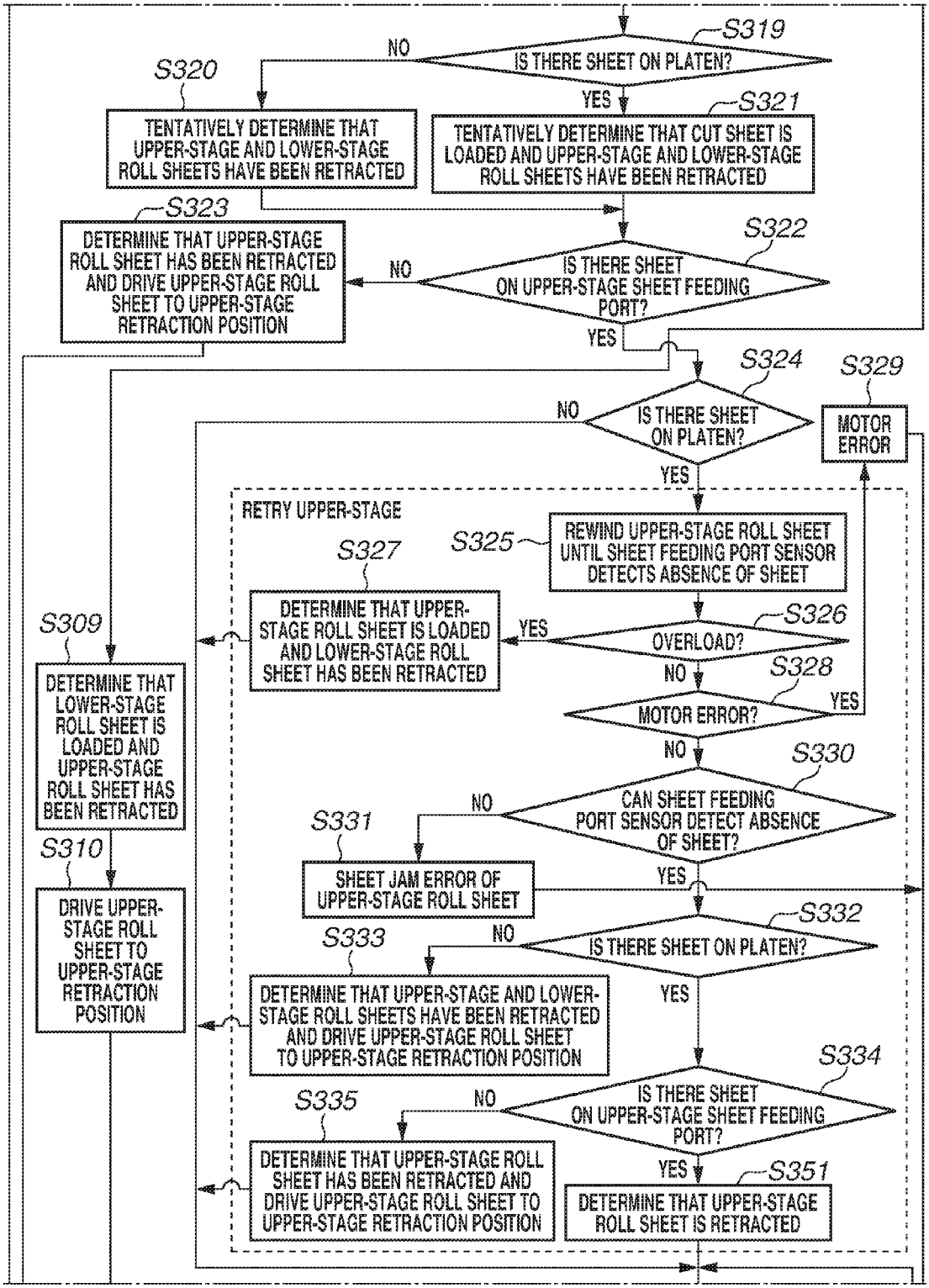
Figure 5C:
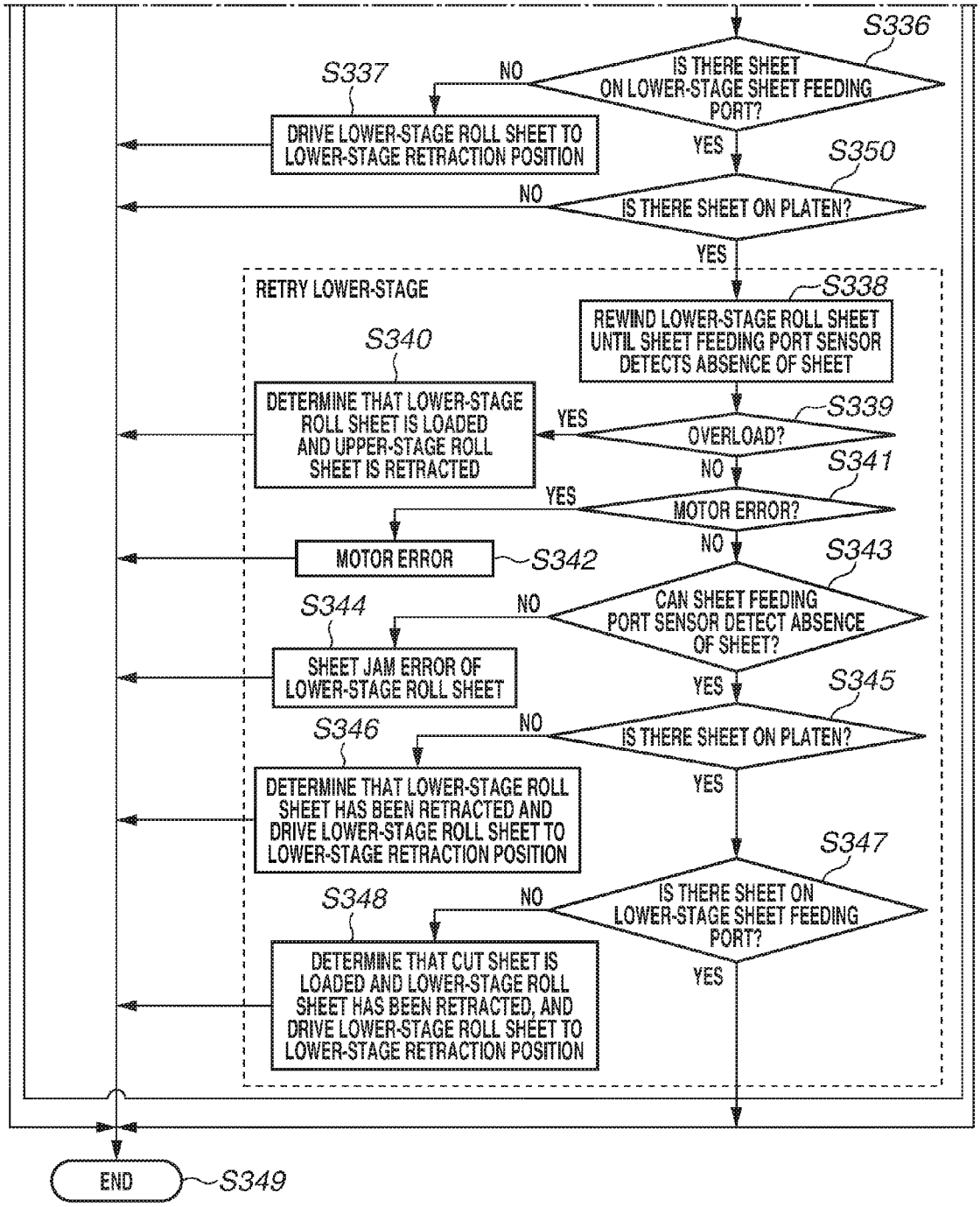

FIGS. 5A, 5B, and 5C are a flowchart illustrating the determination processing performed after step S115. This flowchart illustrates a flow of processing performed by the control unit 30 (the CPU) loading the control program stored in the ROM of the memory unit 36 into the RAM and executing this program.

After step S115, the recording apparatus starts determining which sheet is loaded on the platen 20, the upper-stage roll sheet, the lower-stage roll sheet, or the cut sheet. First, the recording apparatus rewinds the upper-stage roll sheet by rotating the upper-stage roll sheet contained in the sheet feeding unit 12 with use of the driving motor mounted on the shaft of the sheet feeding unit 12 until the upper-stage sheet feeding port sensor 16 detects the absence of the sheet. At the same time as that, the recording apparatus rewinds the lower-stage roll sheet by rotating the lower-stage roll sheet contained in the sheet feeding unit 14 with use of the driving motor mounted on the shaft of the sheet feeding unit 14 until the lower-stage sheet feeding port sensor 17 detects the absence of the sheet. In the present exemplary embodiment, the recording apparatus rewinds the sheets by driving the motors at the same time, but may rewind the sheets individually separately. The recording apparatus rewinds the sheets by rotating the shaft corresponding to the upper-stage roll sheet and the shaft corresponding to the lower-stage roll sheet with the conveyance rollers 11 kept stopped. In the present exemplary embodiment, the rewinding operation has been described as the operation of rewinding each of the roll sheets until the upper-stage sheet feeding port sensor 16 and the lower-stage sheet feeding port sensor 17 each detect the absence of the sheet, but is not limited thereto and the recording apparatus may perform the rewinding operation by rewinding the sheet until the platen sensor 18 detects the absence of the sheet or may perform the rewinding operation by rewinding the sheet by a preset predetermined amount. In the case where the individual sheet feeding units (also referred to as sheet supply units) 12 and 14 include the respective sheet feeding port sensors 16 and 17, like the present exemplary embodiment, the recording apparatus can reach the determination at one time due to the provision of the different sensors 16 and 17. However, in the case where the recording apparatus uses only the single platen sensor 18 for the detection, the recording apparatus moves the sheets separately. For example, in the case where the recording apparatus rewinds the sheet until the platen sensor 18 detects the absence of the sheet, the recording apparatus controls the rewinding operation so as to rewind the lower-stage roll sheet after rewinding the upper-stage roll sheet and determining whether there is no change in the sensor 18 instead of rewinding the roll sheet on the upper-stage sheet feeding unit 12 and the roll sheet on the lower-stage sheet feeding unit 14 at the same time. By this method, the recording apparatus can determine which rewinding operation has caused the platen sensor 18 to detect the absence of the sheet.

Next, in step S303, the recording apparatus determines whether both the motor for rotating the upper-stage roll sheet and the motor for rotating the lower-stage roll sheet have been detected to be overloaded at the time of the operation in step S302. If one of the upper-stage roll sheet and the lower-stage roll sheet is loaded on the platen 20, only one of the upper-stage roll sheet and the lower-stage roll sheet is sandwiched by the conveyance rollers 11, so that only any one of the motors is overloaded. Therefore, both the motors being overloaded suggests a possibility of occurrence of a problem such as both of the upper-stage roll sheet and the lower-stage roll sheet being doubly loaded on the platen 20, and any of the upper-stage roll sheet and the lower-stage roll sheet being jammed. Therefore, if both the motor for rotating the upper-stage roll sheet and the motor for rotating the lower-stage roll sheet have been overloaded (YES in step S303), in step S304, the recording apparatus determines that jam errors of the upper-stage roll sheet and the lower-stage roll sheet have occurred. Then, the recording apparatus displays that the jam errors have occurred on the operation panel 32. By this display, the recording apparatus prompts the user to confirm a sheet path (a conveyance path) of the upper-stage roll sheet and a sheet path (a conveyance path) of the lower-stage roll sheet. Then, the determination processing is ended.

If both the motors have not been overloaded (NO in step S303), in step S305, the recording apparatus determines whether the motor for rotating the upper-stage roll sheet has been overloaded and the lower-stage sheet feeding port sensor 17 has been able to detect the leading edge of the lower-stage roll sheet. If the motor for rotating the upper-stage roll sheet has been overloaded and the lower-stage sheet feeding port sensor 17 has detected the leading edge of the lower-stage roll sheet (YES in step S305), in step S306, the recording apparatus determines that the upper-stage roll sheet is loaded on the platen 20 and the lower-stage roll sheet has been in the retracted state. Then, in step S307, the recording apparatus displaces the lower-stage roll sheet to the retraction position since there is not the sheet now on the lower-stage sheet feeding port. Then, the determination processing is ended.

If the operation in step S302 does not satisfy the conditions in step S305 (NO in step S305), in step S308, the recording apparatus determines whether the motor for rotating the lower-stage roll sheet has been overloaded and the upper-stage sheet feeding port sensor 16 has been able to detect the leading edge of the upper-stage roll sheet. If the motor for rotating the lower-stage roll sheet has been overloaded and the upper-stage sheet feeding port sensor 16 has been able to detect the leading edge of the upper-stage roll sheet (YES in step S308), in step S309, the recording apparatus determines that the lower-stage roll sheet is loaded on the platen 20 and the upper-stage roll sheet has been in the retracted state. Then, in step S310, the recording apparatus displaces the upper-stage roll sheet to the retraction position since there is not the sheet now on the upper-stage sheet feeding port. Then, the determination processing is ended.

If the operation in step S302 does not satisfy the conditions that the motor for rotating the lower-stage roll sheet has been overloaded and the upper-stage sheet feeding port sensor 16 has detected the leading edge of the upper-stage roll sheet (NO in step S308), in step S311, the recording apparatus determines whether another motor error has occurred when having rewound each of the roll sheets until each of the sheet feeding port sensors 16 and 17 has detected the absence of the sheet in step S302. If another motor error has occurred (YES in step S311), in step S312, the recording apparatus processes the motor error. More specifically, the recording apparatus displays on the operation panel 32 that the motor error has occurred, thereby notifying the user of the abnormality. In the present exemplary embodiment, the recording apparatus is configured to detect the motor error in step S311 after checking the overloads in steps S303, 5305, and S308, but may confirm the motor error before checking the overloads. Further, the recording apparatus may be configured to present an error that should be prioritized over the motor error, if such an error has occurred.

If no motor error has occurred (NO in step S311), in step S313, the recording apparatus determines whether both the upper-stage sheet feeding port sensor 16 and the lower-stage sheet feeding port sensor 17 have indicated no detection of the sheet. It is normally impossible that none of the upper-stage sheet feeding port sensor 16 and the lower-stage sheet feeding port sensor 17 has been overloaded and none of them has been able to detect the sheet. Therefore, in step S314, the recording apparatus displays sheet jam errors on the operation panel 32 as the sheet jam errors of the upper-stage roll sheet and the lower-stage roll sheet. By this display, the recording apparatus prompts the user to confirm both the states of the upper-stage roll sheet and the lower-stage roll sheet. Examples of the state yielding the determination of YES in step S313 include a state in which the sheet falls into a situation unable to be tensed back due to the loosened wound state of the roll sheet, a state in which the sheet is unwound off from a core of the roll sheet in the vicinity of the end of the sheet, and the like, regarding both the upper-stage roll sheet and the lower-stage roll sheet.

If the operation in step S302 does not satisfy the condition that both the upper-stage sheet feeding port sensor 16 and the lower-stage sheet feeding port sensor 17 have indicated no detection of the sheet (NO in step S313), in step S315, the recording apparatus determines whether the upper-stage sheet feeding port sensor 16 has indicated no detection of the sheet. If the upper-stage sheet feeding port sensor 16 has indicated no detection of the sheet despite no occurrence of the overload (YES in step S315), in step S316, the recording apparatus displays the sheet jam error on the operation panel 32 as the jam error of the upper-stage roll sheet. By this display, the recording apparatus prompts the user to confirm the state of the upper-stage roll sheet. Then, the processing is ended.

If the upper-stage sheet feeding port sensor 16 has detected the presence of the sheet, i.e., the upper-stage sheet feeding port sensor 16 has not indicated no detection of the sheet (NO in step S315), the processing proceeds to step S317. This is a state in which the upper-stage roll sheet has been able to be rewound from the retraction position to the state corresponding to the absence of the sheet. In step S317, the recording apparatus determines whether the lower-stage sheet feeding port sensor 17 has indicated no detection of the sheet.

If the lower-stage sheet feeding port sensor 17 has indicated no detection of the sheet (YES in step S317), in step S318, the recording apparatus determines that the jam error of the lower-stage roll sheet has occurred. Then, the recording apparatus displays on the operation panel 32 that the jam error of the lower-stage roll sheet has occurred. Then, the determination processing is ended.

If the lower-stage sheet feeding port sensor 17 has detected the sheet, i.e., the lower-stage sheet feeding port sensor 17 has not indicated no detection of the sheet (NO in step S317), the processing proceeds to step S319. This is a state in which the lower-stage roll sheet has been able to be rewound from the retraction position to the state corresponding to the absence of the sheet. In step S319, the recording apparatus determines whether there is the sheet on the platen 20 with use of the platen sensor 18. When the flow proceeds to as far as step S319, the recording apparatus has been able to confirm that the leading edges of both the upper-stage roll sheet and the lower-stage roll sheet have not been undetected, and therefore the advancement to step S319 means that the leading edges have been able to be detected normally. In other words, the recording apparatus can figure out that the upper-stage roll sheet and the lower-stage roll sheet have been in the retracted state, which allows the recording apparatus to determine whether no sheet is loaded or the cut sheet is loaded based on whether there is the sheet on the platen 20. Therefore, in step S319, the recording apparatus detects whether there is the sheet on the platen 20.

At this time, in the present exemplary embodiment, the recording apparatus performs the operation of retrying rewinding the sheet with respect to each of the upper-stage roll sheet and the lower-stage roll sheet in consideration of, for example, a possibility that the sensor 16 or 17 may have output false detection due to slack of the roll sheet when the roll sheet has been conveyed until the sensor 16 or 17 has detected the absence of the sheet. More specifically, in steps S320 and 321, the recording apparatus tentatively determines the state for now, assuming that the leading edges of the roll sheets have been able to be detected. More specifically, if the recording apparatus determines that there is no sheet on the platen 20 (NO in step S319), in step S320, the recording apparatus tentatively determines that the sheet feeding state is the state in which the upper-stage roll sheet and the lower-stage roll sheet have been in the retracted state and no sheet is loaded. If the recording apparatus determines that there is the sheet on the platen 20 (YES in step S319), in step S321, the recording apparatus tentatively determines that the sheet feeding state is the state in which the sheet placed on the platen 20, i.e., the loaded sheet is the cut sheet, and the upper-stage roll sheet and the lower-stage roll sheet have been in the retracted state. Next, in step S322, the recording apparatus determines whether there is the sheet on the upper-stage sheet feeding port with use of the upper-stage sheet feeding port sensor 16. If there is no sheet on the upper-stage sheet feeding port (NO in step S322), this can lead to confirmation that the upper-stage roll sheet has been able to be rewound normally. Therefore, if the recording apparatus determines that there is no sheet on the upper-stage sheet feeding port (NO in step S322), the recording apparatus drives the upper-stage roll sheet to the retraction position, and the processing proceeds to step S336 in which the recording apparatus checks whether to perform the subsequent retry operation with respect to the lower-stage roll sheet. If the recording apparatus determines that there is the sheet on the upper-stage sheet feeding port (YES in step S322), the recording apparatus determines that the detection of the absence of the sheet when the upper-stage roll sheet has been rewound in step S302 has been the false detection, and the processing proceeds to step S324. In step S324, the recording apparatus determines whether there is the sheet on the platen 20 with use of the platen sensor 18. If no the sheet is detected on the platen 20 in step S324 (NO in step S324) after an attempt to rewind the upper-stage roll sheet, the processing proceeds to step S336 to process the lower-stage roll sheet, assuming that the upper-stage roll sheet has been rewound.

However, since the upper-stage sheet feeding port sensor 16 detects the presence of the sheet and the platen sensor 18 detects the absence of the sheet, the upper-stage roll sheet can be determined to be located between the upper-stage sheet feeding port sensor 16 and the platen sensor 18. However, a detailed position of the upper-stage roll sheet is unknown, whereby the recording apparatus may be configured in such a manner that the processing proceeds to step S325, or the recording apparatus rewinds the upper-stage roll sheet until the sensor 16 detects the absence of the sheet again to thereby detect the position of the leading edge again, without making the determination in step S324.

Further or alternatively, because there is a possibility that the upper-stage roll sheet may have been rewound to an ambiguous position indecisive between the presence of the sheet and the absence of the sheet, the recording apparatus may be configured in such a manner that the processing proceeds to step S336 after the recording apparatus slightly forwards the sheet in an opposite direction from the direction for rewinding the sheet so as to ensure that the sheet feeding port sensor 16 detects the presence of the sheet. If the recording apparatus determines that there is the sheet on the platen 20 (YES in step S324), in step S325, the recording apparatus performs the operation of retrying rewinding the upper-stage roll sheet only once, assuming that the operation having detected the absence of the sheet in step S302 has been the false detection, and in consideration of a further possibility that the sheet on the platen 20 may be the upper-stage roll sheet. The retry operation described here refers to the operation of rewinding the upper-stage roll sheet until the upper-stage sheet feeding port sensor 16 detects the absence of the sheet. Then, the processing proceeds to step S326.

In step S326, the recording apparatus determines whether the motor for rotating the upper-stage roll sheet has been detected to be overloaded at the time of the operation in step S325. If the overload has been detected (YES in step S326), in step S327, the recording apparatus determines that the upper-stage roll sheet is loaded on the platen 20. In this case, the lower-stage roll sheet is kept tentatively determined to have been in the retracted state. Then, the processing proceeds to step S336.

If the overload has not been able to be detected in step S326 (NO in step S326), in step S328, the recording apparatus determines whether the motor error has occurred. If the motor error has occurred (YES in step S328), the recording apparatus displays on the operation panel 32 that the motor error has occurred, thereby notifying the user of the abnormality. Then, the determination processing is ended. If the motor error has not occurred (NO in step S328), in step S330, the recording apparatus determines whether the upper-stage sheet feeding port sensor 16 has become able to detect the absence of the sheet as a result of the operation in step S325. Since the upper-stage roll sheet has been conveyed until the upper-stage sheet feeding port sensor 16 has detected the absence of the sheet in step S325, if the upper-stage sheet feeding port sensor 16 has not become able to detect the absence of the sheet (NO in step S330) even after the upper-stage roll sheet has been conveyed by the predetermined amount, in step S331, the recording apparatus performs processing, assuming that the upper-stage roll sheet is stuck in the sheet jam error. More specifically, the recording apparatus displays, on the operation panel 32 of the main body, that the upper-stage roll sheet is stuck in the sheet jam error. By this display, the recording apparatus prompts the user to confirm the state of the roll sheet. Then, the determination processing is ended. Examples of the state causing the processing to proceed to step S331 include a state in which there is some problem, such as the upper-stage roll sheet falling into the state unable to be tensed back due to the loosened wound state of the upper-stage roll sheet or the upper-stage roll sheet unwound off from the core of the upper-stage roll sheet in the vicinity of the end of the sheet. Therefore, the recording apparatus can cause the user to confirm the state of the upper-stage roll sheet by notifying the user of the sheet jam error. In this case, if the user performs an operation for resolving the jam, such as removing the sheet, this allows the user to continuously operate the recording apparatus, unlike the motor error. If the upper-stage sheet feeding port sensor 16 detects the absence of the sheet as the result of the operation in step S325, i.e., if the upper-stage sheet feeding port sensor 16 does not indicate detection of the sheet (YES in step S330), in step S332, the recording apparatus determines whether there is the sheet on the platen 20 with use of the platen sensor 18. If there is no sheet on the platen 20 (NO in step S332), this can lead to a determination that the sheet originally located on the platen 20 has been the upper-stage roll sheet, and rewinding the upper-stage roll sheet has resulted in the absence of the sheet. Therefore, in step S333, the recording apparatus determines that the upper-stage roll sheet has been in the retracted state. Further, since there is no sheet on the platen 20, the recording apparatus can determine that the lower-stage roll sheet has been also in the retracted state, and no sheet is loaded. Then, the recording apparatus moves the upper-stage roll sheet to the upper-stage retraction position, and the processing proceeds to step S336. The determination processing is not limited thereto, and may be configured to be ended without proceeding to the processing of the lower-stage roll sheet since the lower-stage roll sheet is also confirmed to have been located at the retraction position.

If the recording apparatus determines that there is the sheet on the platen 20 (YES in step S332), in step S334, the recording apparatus determines whether there is the sheet on the upper-stage sheet feeding port with use of the upper-stage sheet feeding port sensor 16. If the recording apparatus detects that there is no sheet on the upper-stage sheet feeding port (NO in step S334), in step S335, the recording apparatus determines that the upper-stage roll sheet has been retracted. In this case, there is a possibility that the sheet on the platen 20 may be the cut sheet, and there is also a possibility that the sheet on the platen 20 may be the lower-stage roll sheet if false detection has occurred on the platen 20. Therefore, the recording apparatus moves the upper-stage roll sheet to the upper-stage retracted position, and the processing proceeds to step S336. If the recording apparatus determines that there is the sheet on the upper-stage sheet feeding port (YES in step S334), the recording apparatus can determine that the upper-stage roll sheet is in the retracted state although the sheet on the platen 20 is any of the cut sheet and the lower-stage roll sheet. Therefore, in step S351, the recording apparatus determines that the upper-stage roll sheet is in the retracted state, and the processing proceeds to step S336 directly therefrom. In the present exemplary embodiment, if the recording apparatus determines that there is the sheet on the upper-stage sheet feeding port in step S334 (YES in step S334), the processing proceeds to step S336, but the determination processing is not limited thereto. Because it is an abnormal state that the presence of the sheet is detected despite the fact that the upper-stage roll sheet is supposed to have been conveyed until the upper-stage sheet feeding port sensor 16 has detected the absence of the sheet, the recording apparatus may repeat the retry operation several times, such as twice and three times, and/or may be configured to display this state as the jam on the operation unit 32. Further or alternatively, because there is a possibility that the rewinding operation may have rewound the upper-stage roll sheet to the ambiguous position indecisive between the presence of the sheet and the absence of the sheet, the recording apparatus may be configured in such a manner that the processing proceeds to step S336 after the recording apparatus slightly forwards the upper-stage roll sheet in the opposite direction from the direction for rewinding the upper-stage roll sheet so as to ensure that the presence of the sheet can be detected on the upper-stage sheet feeding port. Further, the recording apparatus may perform the operation of conveying the upper-stage roll sheet to the retraction position for the upper-stage roll sheet.

Upon an end of the determination processing based on the operation of retrying rewinding the upper-stage roll sheet, the recording apparatus performs the determination processing based on the operation of retrying rewinding the lower-stage roll sheet, similarly to the upper-stage roll sheet.

In step S336, the recording apparatus detects whether there is the sheet on the lower-stage sheet feeding port with use of the lower-stage sheet feeding port sensor 17. If the recording apparatus detects that there is no sheet on the lower-stage sheet feeding port (NO in step S336), in step S337, the recording apparatus displaces the lower-stage roll sheet to the retraction position since being able to confirm that the lower-stage roll sheet has been rewound normally by the operation in step S302. Then, the determination processing is ended. If the recording apparatus detects that there is the sheet on the lower-stage sheet feeding port (YES in step S336), the processing proceeds to step S350, assuming that the detection of the absence of the sheet when the lower-stage roll sheet has been rewound by the operation in step S302 has been the false detection. In step S350, the recording apparatus determines whether there is the sheet on the platen 20 with use of the platen sensor 18. If the recording apparatus detects that there is no sheet on the platen 20 (NO in step S350), the determination processing is ended, assuming that the lower-stage roll sheet has been rewound. At this time, a position of the lower-stage roll sheet is unknown, whereby the recording apparatus may be configured in such a manner that the processing omits step S350 or proceeds to step S338, or the recording apparatus rewinds the lower-stage roll sheet until the sensor 17 detects the absence of the sheet again to thereby detect the position of the leading edge again. Further or alternatively, because there is a possibility that the lower-stage roll sheet may have been rewound to the ambiguous position indecisive between the presence of the sheet and the absence of the sheet, the recording apparatus may be configured to end the processing after slightly forwarding the sheet in the opposite direction from the direction for rewinding the sheet so as to ensure that the sheet feeding port sensor 17 detects the presence of the sheet. If the recording apparatus determines that there is the sheet on the platen 20 (YES in step S350), in step S338, the recording apparatus performs the operation of retrying rewinding the lower-stage roll sheet only once, assuming that the detection of the absence of the sheet as a result of the execution of step S302 has been the false detection. The recording apparatus rewinds the lower-stage roll sheet until the lower-stage sheet feeding port sensor 17 detects the absence of the sheet.

Next, in step S339, the recording apparatus determines whether the overload has been detected at the time of the operation in step S338. If the recording apparatus determines that the overload has been detected (YES in step S339), in step S340, the recording apparatus determines that the lower-stage roll sheet is loaded because of being able to determine that the motor has been overloaded due to the lower-stage roll sheet sandwiched by the conveyance rollers 11. In this case, the upper-stage roll sheet is kept tentatively determined to have been in the retracted state.

If the recording apparatus determines that the overload has not been detected (NO in step S339), in step S341, the recording apparatus determines whether the motor error has occurred. If the recording apparatus determines that the motor error has occurred (YES in step S341), the recording apparatus displays that the motor error has occurred on the operation panel 32 of the main body, thereby notifying the user of the abnormality. Then, the determination processing is ended. If the recording apparatus determines that the motor error has not occurred (NO in step S341), in step S343, the recording apparatus determines whether the lower-stage sheet feeding port sensor 17 has become able to detect the absence of the sheet as a result of the operation in step S338. Since the lower-stage roll sheet has been conveyed until the lower-stage sheet feeding port sensor 17 has detected the absence of the sheet in step S338, if the lower-stage sheet feeding port sensor 17 has not become able to detect the absence of the sheet (NO in step S343) even after the lower-stage roll sheet has been conveyed by the predetermined amount, the recording apparatus displays on the operation panel 32 of the main body that the sheet jam error of the lower-stage roll sheet has occurred. By this display, the recording apparatus prompts the user to confirm the state of the lower-stage roll sheet. Then, the determination processing is ended. Examples of the state yielding the determination of NO in step S343 include a state in which there is some problem, such as the lower-stage roll sheet falling into the state unable to be tensed back due to the loosened wound state of the lower-stage roll sheet or the lower-stage roll sheet unwound off from the core of the roll sheet in the vicinity of the end of the sheet. In this case, if the user performs the operation for resolving the jam, such as removing the sheet, this allows the user to continuously operate the recording apparatus, unlike the motor error. The recording apparatus may be configured to make another determination without determining that the jam has occurred similarly to the description of FIG. 4, and/or make the determination by combining the error in the processing of the upper-stage roll sheet similarly to the above description.

If the lower-stage sheet feeding port sensor 17 detects the absence of the sheet as the result of the operation in step S338, i.e., if the lower-stage sheet feeding port sensor 17 does not detect the presence of the sheet (YES in step S343), in step S345, the recording apparatus determines whether there is the sheet on the platen 20 with use of the platen sensor 18. If there is no sheet on the platen 20 (NO in step S345), this can lead to a determination that the sheet originally located on the platen 20 has been the lower-stage roll sheet, and rewinding the lower-stage roll sheet has resulted in the absence of the sheet. Therefore, in step S346, the recording apparatus determines that the lower-stage roll sheet has been in the retracted state, and no sheet is loaded. Then, the recording apparatus conveys the lower-stage roll sheet to the lower-stage retraction position, and the determination processing is ended.

If there is the sheet on the platen 20 (YES in step S345), in step S347, the recording apparatus detects whether there is the sheet on the lower-stage sheet feeding port with use of the lower-stage sheet feeding port sensor 17 by step S347. If there is no sheet on the lower-stage sheet feeding port (NO in step S347), in step S348, the recording apparatus can determine that the lower-stage roll sheet has been retracted, and therefore can also determine that the sheet on the platen 20 is the cut sheet. In other words, the recording apparatus can determine that the cut sheet is loaded. The lower-stage roll sheet has been moved to the position corresponding to the absence of the sheet, whereby the recording apparatus conveys the lower-stage roll sheet to the lower-stage retraction position, and the determination processing is ended. If the recording apparatus determines that there is the sheet on the lower-stage sheet feeding port (YES in step S347), the determination processing is ended. Since the absence of the sheet has been detected when the sheet has been rewound, the processing proceeds, and the recording apparatus determines that the sheet on the platen 20 is the cut sheet and the lower-stage roll sheet is in the retracted state.

The determination processing illustrated in FIGS. 5A, 5B, and 5C allow the recording apparatus to determine which sheet is loaded when there is a possibility that any of the three sheets, the upper-stage roll sheet, the lower-stage roll sheet, and the cut sheet may be loaded on the platen 20. In the present exemplary embodiment, the recording apparatus starts the sheet feeding operation after the flows illustrated in FIGS. 3 to 5 are performed. At this time, the recording apparatus performs the sheet feeding operation in an upper-stage roll sheet mode, a lower-stage roll sheet mode, or a cut sheet mode. The recording apparatus determines, based on results of the determinations illustrated in FIGS. 3 to 5, in which mode the recording apparatus operates among the upper-stage roll sheet mode, the lower-stage roll sheet mode, and the cut sheet mode. More specifically, the recording apparatus operates in the upper-stage roll sheet mode if determining that the sheet loaded on the platen 20 is the upper-stage roll sheet, and operates in the lower-stage roll sheet mode if determining that the sheet loaded on the platen 20 is the lower-stage roll sheet. Further, the recording apparatus operates in the cut sheet mode if determining that the sheet loaded on the platen 20 is the cut sheet. A sheet feeding flow, a parameter, and the like vary depending on which mode is employed among the upper-stage roll sheet mode, the lower-stage roll sheet mode, and the cut sheet mode. For example, if the employed mode is the cut sheet mode, the recording apparatus performs the processing for identifying the length of the cut sheet. Alternatively, the recording apparatus switches the driving unit for performing the sheet feeding operation (determines the driving unit) according to whether the employed mode is the upper-stage roll sheet mode or the lower-stage roll sheet mode. Further, the recording apparatus changes the parameter of the sheet feeding operation and the like as necessary. More specifically, for example, the recording apparatus sets different values as an application amount of the back tension between the roll sheet fed from the upper-stage sheet feeding unit 12 and the roll sheet fed from the lower-stage sheet feeding unit 14, thereby arranging the sheet feeding operation so as to achieve a predetermined torque in either case.

In either case, upon a start of the sheet feeding operation, the recording apparatus automatically detects the position of the leading edge, the left and right edges, and the like of the sheet with use of the sensor on the carriage 10. The recording apparatus may be configured not to automatically detect a width of the sheet and configured to cause the user to input the width of the sheet and the like via the operation panel 32. After that, the recording apparatus moves the sheet to the retraction position if necessary.

As a result, the upper-stage roll sheet is brought into a state ready for the printing if the upper-stage roll sheet is loaded on the platen 20, and the lower-stage roll sheet is brought into a state ready for the printing if the lower-stage roll sheet is loaded on the platen 20. Further, the cut sheet is brought into a state ready for the printing if the cut sheet is loaded on the platen 20. The recording apparatus may be configured to move the roll sheet onto the platen 20 after removing the cut sheet when performing the sheet feeding operation if determining that the cut sheet is fed on the platen 20. In this case, the recording apparatus performs the sheet feeding operation in the roll sheet mode.

Then, upon receiving pressing of a start button on the recording apparatus or receiving a start instruction from an external apparatus, such as a personal computer (PC), the recording apparatus carries out the printing based on the print data.

Now, display screens displayed on the operation panel 32 under the display control by the control unit 30 will be described with reference to FIGS. 6A to 6H. FIGS. 6A to 6H each illustrate a part of the display screen on the operation panel 32. Each of them is one example of an exemplary display for notifying the user of the state of the printer and the type of the sheet loaded on the platen 20, and is displayed when, for example, the recording apparatus is waiting before starting the printing.

In the present exemplary embodiment, each of the display screens includes an area for displaying a message, an area for displaying a remaining ink amount, an area for displaying the sheet type, and a display area for indicating an instruction for maintenance, which are presented on the display screen.

If the platen sensor 18 does not detect the sheet, i.e., if there is no sheet on the platen 20, the recording apparatus displays the screen illustrated in FIG. 6A on the operation panel 32 because the present sheet feeding state is the state in which no sheet is loaded. The recording apparatus displays a message for prompting the user to load the sheet, such as "please load the sheet" in the area for displaying the message. This display can make the user aware that no sheet is loaded. Further, the recording apparatus displays the remaining ink amount for each color in the area for displaying the remaining ink amount. The recording apparatus displays the sheet information indicating the sheet type (a material) of each of the upper-stage roll sheet, the lower-stage roll sheet, and the cut sheet in the area for displaying the sheet type. FIG. 6A illustrates the display screen displayed with no sheet loaded yet, whereby the sheet information is not displayed on this screen. The recording apparatus displays a maintenance button in the display area for indicating the instruction for maintenance. The maintenance button is a menu screen for maintenance, and triggers a display of a maintenance list upon being selected.

If the sheet is loaded on the platen 20, the recording apparatus displays a message notifying the user that the recording apparatus is ready to start the printing, like, for example, "ready to print", as illustrated in FIG. 6B. Further, if the upper-stage roll sheet is loaded on the platen 20, the recording apparatus displays the type of the loaded sheet (the material of the loaded sheet) in thick and dark characters in a field to the right of the upper-stage roll sheet. By this display, the recording apparatus allows the user to identify that the sheet loaded on the platen 20 is the upper-stage roll sheet and the type of the sheet is plain paper. The recording apparatus may be configured to display the sheet loaded on the platen 20 so as to make this sheet identifiable by another method.

On this screen, the recording apparatus displays information input by the user via an input screen displayed on the operation panel 32 after the determination processing illustrated in FIGS. 3 to 5 is performed, as the type of the sheet (the material of the sheet). The user may input a character string indicating the material of the loaded sheet or may input the material of the loaded sheet by selecting it from a pull-down menu. A timing when the user inputs the type of the sheet is not limited to the timing after the determination processing is performed, and the recording apparatus may be configured to cause the user to input the type of the sheet at a timing before performing the determination processing, such as when the sensor 18 on the platen 20 detects the presence of the sheet. Further, in a case where the material of the sheet can be determined from the sensor, the display of the input screen on the operation panel 32 may be omitted.

The display screens illustrated in FIGS. 6C to 6H are each displayed when the recording apparatus performs the sheet feeding operation according to the loaded sheet and is set into a waiting state after determining whether the loaded sheet is the cut sheet, the upper-stage roll sheet, or the lower-stage roll sheet by performing the processing flows illustrated in FIGS. 3 to 5. The display screens illustrated in FIGS. 6C to 6H include the area for displaying the message, the area for displaying the remaining ink amount, and the display area for indicating the instruction for maintenance that are similar to those on the screen illustrated in FIG. 6B, and therefore FIGS. 6C to 6H illustrate only the area for displaying the sheet type.

If the lower-stage roll sheet is loaded on the platen 20, the recording apparatus displays the type of the loaded sheet in thick and dark characters to the right of a character string indicating the lower-stage roll sheet, as illustrated in FIG. 6C. If the cut sheet is loaded, the recording apparatus displays the type of the loaded sheet in thick and dark characters to the right of a character string indicating the cut sheet, as illustrated in FIG. 6D. The right side of a character string indicating the unloaded sheet is left blank.

If the cut sheet is loaded on the platen 20 and the upper-stage roll sheet is in the retracted state, the recording apparatus displays the type of the sheet in thick and dark characters to the right of the character string indicating the cut sheet, and displays the type of the sheet in thin and light characters to the right of the character string indicating the upper-stage roll sheet in the retracted state, as illustrated in FIG. 6E. In the present exemplary embodiment, the recording apparatus displays the sheet information so as to display the type of the sheet loaded on the platen 20 in the thick and dark characters and display the type of the sheet in the retracted state in the thin and light characters. The display screen illustrated in FIG. 6F is a display example when the sheet feeding state is the state in which the upper-stage roll sheet and the lower-stage roll sheet are in the retracted state and the cut sheet is loaded on the platen 20. The display screen illustrated in FIG. 6G is a display example when the upper-stage roll sheet is loaded on the platen 20 and the lower-stage roll sheet is in the retracted state. In the present exemplary embodiment, in this state, the right side of the character string indicating the cut sheet is left blank because the cut sheet cannot be fed. In the present exemplary embodiment, the blank field is assumed to indicate the state in which the corresponding sheet is not fed. The display screen illustrated in FIG. 6H is a display example when the lower-stage roll sheet is loaded on the platen 20 and the upper-stage roll sheet is in the retracted state. In this case, the right side of the character string indicating the cut sheet is also left blank because the cut sheet cannot be fed.

The display screens illustrated in FIGS. 6A to 6H have been described as displaying the sheet information so as to display the type of the sheet loaded on the platen 20 in the thick and dark characters and display the type of the sheet in the retracted state in the thin characters, but the display method is not limited thereto. The sheet information may be displayed in any manner as long as the type of the sheet loaded on the platen 20 and the type of the sheet in the retracted state are displayed distinguishably from each other. Further, the type of the sheet such as the upper-stage roll sheet has been described as being indicated by the character string, but is not limited thereto and may be indicated by a symbol such as an icon representing the roll sheet.

In the present exemplary embodiment, the recording apparatus can automatically determine which sheet is loaded when the sheet is loaded. More specifically, the recording apparatus can automatically determine which feeding source (the sheet feeding unit 12, the sheet feeding unit 14, or the manual feeding port) feeds the sheet. Therefore, the user no longer has to select the roll sheet mode or the cut sheet mode. This unnecessity can prevent a mismatch between the operation mode and the actual type of the sheet, such as a mismatch when the user loads the roll sheet although selecting the cut sheet mode.

Further, the present exemplary embodiment allows the recording apparatus to determine that the cut sheet is loaded without moving the cut sheet, which eliminates the necessity of especially imposing a limit on the position where the cut sheet can be loaded (the position of the trailing edge of the cut sheet). For example, supposing that the roll sheet is loaded by mistake in the cut sheet mode, this results in an error because the recording apparatus cannot find the trailing edge even after conveying the sheet by 1600 mm, which is a maximum size of the cut sheet, with the aim of measuring the sheet length of the cut sheet. Therefore, the position of the cut sheet may be set so as to require the trailing edge of the cut sheet to be located in the vicinity of the platen sensor 18 to prevent wasteful conveyance due to false detection of the error. For example, the loading position is set in such a manner that the trailing edge of the sheet is located in a region within 50 mm upstream from the platen sensor 18. In this case, the recording apparatus can determine that the error has occurred if being unable to find the trailing edge even after moving the sheet by approximately 50 mm at most. However, this leads to the limit imposed on the position where the sheet can be loaded, making it impossible to load the sheet by inserting the sheet further deeply (toward the upstream side). A performance regarding the loading of the cut sheet is deteriorated. On the other hand, the present exemplary embodiment is free from such a problem.

Further, all the user has to do is to load the sheet, which contributes to simplification of the procedure. Further, conventionally, the recording apparatus has been equipped with the button for switching the roll sheet and the cut sheet and a light emitting diode (LED) displaying the sheet feeding mode on the operation panel 32 to make it less likely to forget to switch the mode, but the recording apparatus no longer has to include this configuration. Therefore, the present exemplary embodiment can realize a size reduction and cost cutting of the panel 32.

Further, in the present exemplary embodiment, the recording apparatus determines whether the loaded sheet is the roll sheet or the cut sheet before starting the sheet feeding operation, which allows the recording apparatus to perform the sheet feeding operation specifically designed for each of the roll sheet and the cut sheet.

Further, the display on the operation panel 32 allows the user to confirm which sheet is loaded and placed on the platen 20 and further confirm whether the roll sheet is located at the retraction position.

Further, in the present exemplary embodiment, the recording apparatus can make the above-described determination by using the sensors 16, 17, and 18 mounted on the upstream side of the conveyance rollers 11 that are necessary to detect the end of the roll, and therefore can reduce the number of sensors. Further, the recording apparatus does not necessarily have to include the configuration for separating the conveyance rollers 11 from each other.

Further, in the present exemplary embodiment, the recording apparatus can be prevented from determining that the sheet loaded on the platen 20 is the cut sheet when the winding of the roll sheet loaded on the platen 20 is loosened. Further, the recording apparatus can be prevented from determining that the sheet loaded on the platen 20 is the cut sheet when the roll sheet is unwound at the end of the roll sheet loaded on the platen 20.

Further, in the present exemplary embodiment, the recording apparatus does not convey the sheet by using the conveyance rollers 11 when determining the type of the sheet. Some sheets are left with a mark by being conveyed by the conveyance rollers 11 several times in a case where the conveyance rollers 11 sandwich the sheet therebetween with a certain high pressure, but the present exemplary embodiment can also prevent the sheet from being left with the mark by being conveyed by the conveyance rollers 11. Further, in the present exemplary embodiment, the recording apparatus can determine that the jam has occurred even when the sensor outputs the false detection, for example, when the winding of the roll sheet is loosened. Therefore, the present exemplary embodiment allows the recording apparatus to cause the user to confirm the state of the sheet before continuing the operation based on the false detection to then let the damage expand.

According to the present exemplary embodiment, the recording apparatus can automatically determine which feeding source feeds the sheet.

(Other Exemplary Embodiments)

The present invention is not limited to the above-described configuration. For example, in the above-described exemplary embodiment, the recording apparatus is configured to determine whether the motor error has occurred after determining whether the overload has been detected. However, the present invention is not limited thereto, and the recording apparatus may be configured to determine whether the motor error has occurred before determining whether the overload has been detected.

Further, in the above-described exemplary embodiment, the error other than the overload error has been described citing the motor error as an example thereof, but the recording apparatus may be configured to determine another error.

Further, determining whether (1) the sheet fed on the platen 20 is the upper-stage roll sheet or (2) the sheet fed on the platen 20 is the cut sheet and the upper-stage roll sheet is located at the retraction position is not limited to the flow illustrated in FIG. 4. For example, the recording apparatus is configured to be able to distinguish the false determination due to the slack of the roll sheet by making the determination in step S211 illustrated in FIG. 4, but does not have to make this determination. Further, the flow illustrated in FIG. 4 has been described as proceeding to step S212 if the retry processing is about to be performed for the second time, but the recording apparatus may be configured to repeat the retry operation several times, such as twice and three times. This is because it is an abnormal state that the upper-stage sheet feeding port sensor 16 detects the presence of the sheet despite the fact that the upper-stage roll sheet is supposed to have been conveyed until the upper-stage sheet feeding port sensor 16 has detected the absence of the sheet.

Further, the recording apparatus may be configured to notify the user that the jam has occurred, thereby prompting the user to confirm the state of the recording apparatus in step S213 illustrated in FIG. 4. In other words, the recording apparatus causes the user to remove the sheet and load the sheet again.

Further, in step S212, the recording apparatus determines that the cut sheet is fed on the platen 20, but the determination processing is not limited thereto and the recording apparats may be configured to determine that the upper-stage roll sheet is fed on the platen 20 since the upper-stage sheet feeding port sensor 16 detects the presence of the sheet.

Further, the flow illustrated in FIG. 4 has been described as returning to step S201 to move the upper-stage roll sheet until the upper-stage sheet feeding port sensor 16 detects the absence of the sheet if the upper-stage sheet feeding port sensor 16 determines the presence of the sheet in step S211, but the determination processing is not limited thereto and the recording apparatus may be configured in such a manner that the processing proceeds to step S212 after the recording apparatus forwards the upper-stage roll sheet by a small amount in the opposite direction from the direction for rewinding the upper-stage roll sheet. This is an operation for ensuring that the upper-stage sheet feeding port sensor 16 detects the presence of the sheet, with a determination that the sheet has been detected not to be located on the upper-stage sheet feeding port in step S201 due to the execution of the operation of rewinding the upper-stage roll sheet to the ambiguous position indecisive between the presence of the sheet and the absence of the sheet. In this case, the operation of moving the upper-stage roll sheet to the upper-stage retraction position in step S210 may be omitted.

Further, determining any of (1) the state in which the cut sheet is loaded and the upper-stage roll sheet and the lower-stage roll sheet are retracted, (2) the state in which the upper-stage roll sheet is loaded and the lower-stage roll sheet is in the retracted state, and (3) the state in which the lower-stage roll sheet is loaded and the upper-stage roll sheet is in the retracted state is not limited to the flow illustrated in FIGS. 5A, 5B, and 5C. For example, the flow illustrated in FIGS. 5A, 5B, and 5C have been described as tentatively determining the sheet feeding state to perform the operation of retrying rewinding the roll sheet, but the recording apparatus may immediately determine (distinguish) the sheet feeding state and end the processing without tentatively determining the sheet feeding state. In this case, for example, the recording apparatus may be configured to move the sheet so as to resolve the loosened winding in advance.

In the above-described exemplary embodiment, the recording apparatus has been described as including the two stages as the sheet feeding units for the roll sheets, but is not limited thereto and may include three or more stages. Even in this case, the recording apparatus can determine which sheet is loaded among the cut sheet and the plurality of roll sheets by a similar method to the above-described exemplary embodiment. Further, the recording apparatus may be configured not to include the lower-stage roll sheet. Even in this case, the present invention can be applied by using a similar flowchart to the above-described exemplary embodiment.

Further, the sheet feeding port sensor(s) 16 and/or 17 may be omitted. In this case, the present invention can be applied by replacing the term "sheet feeding port sensor" with the term "platen sensor".

In the above-described exemplary embodiment, the recording apparatus determines whether the roll sheet is sandwiched by the conveyance rollers 11 based on whether the overload of the motor has been detected, but this determination is not limited thereto. For example, a torque of the motor may be used as an output value associated with the driving of the motor. In other words, the recording apparatus may determine whether the roll sheet is sandwiched based on the torque of the motor. More specifically, the recording apparatus may be configured to determine that the roll sheet is sandwiched if the torque of the motor exceeds a predetermined torque when rewinding the sheet while detecting the torque of the motor. Alternatively, the recording apparatus may be configured to include an encoder mounted on the core of the roll sheet, and detect how much the roll sheet is conveyed by detecting a rotational angle of the roll sheet. Alternatively, the recording apparatus may also be configured to directly detect whether the roll sheet is moving with use of a sensor capable of determining that the roll sheet is being displaced, and detect that the roll sheet is sandwiched by the conveyance rollers 11 if the roll sheet is not moving.

In the above-described exemplary embodiment, the recording apparatus has been described as performing the processing for determining the sheet upon detecting that the release lever is opened, but the determination of the sheet is not limited thereto. For example, if the upper-stage sheet feeding port sensor 16 or the lower-stage sheet feeding port sensor 17 detects the absence of the sheet before the release lever is opened and this detection changes to the presence of the sheet when the release lever is closed, this can lead to a determination that a new sheet is loaded on this sheet feeding port. Therefore, the recording apparatus may determine that the roll sheet fed from this sheet feeding port is loaded on the platen 20 without performing the flow illustrated in FIG. 3. In this case, the recording apparatus performs the sheet feeding operation after that. Further, in the present exemplary embodiment, if the roll sheet in the fed state is rewound into the retracted state, this retraction is stored into the memory unit 36 or the like. Therefore, the recording apparatus may be configured to, if not storing that the sheet is rewound into the retracted state and determining that the sheet is in the retracted state when the release lever is closed, determine that this sheet is newly loaded and refrain from performing the flow illustrated in FIG. 3. In this case, the recording apparatus performs the sheet feeding operation after that. If storing that the sheet is rewound into the retracted state and determining that the sheet is also in the retracted state after the release lever is closed, the recording apparatus does not have to perform the sheet feeding operation.

Further, in the above-described exemplary embodiment, the recording apparatus has been described as being able to determine whether the sheet fed on the platen 20 is the cut sheet or the roll sheet, but the recording apparatus incapable of feeding the cut sheet may determine which feeding source feeds the sheet on the platen 20. In this case, for example, the driving unit for the sheet feeding operation is switched according to which feeding source feeds the sheet. Further, the parameter to be used in the sheet feeding operation, such as the back tension, is changed as necessary.

Further, in the above-described exemplary embodiment, the recording apparatus has been described as a serial printer causing the carriage 10 to scan in the direction intersecting with the direction in which the sheet is conveyed, but is not limited thereto. For example, the recording apparatus may be a so-called full multi-head printer including nozzles lined in a range covering a width of a print region of a sheet having a maximum size usable by the printer.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-201313, filed Oct. 9, 2015, which is hereby incorporated by reference herein in its entirety.

What is claimed is:

1. A recording apparatus comprising:

a plurality of feeding units each configured to feed a sheet;

a conveyance unit provided on an upstream side of a recording unit in a direction in which the sheet is conveyed, wherein the conveyance unit conveys the sheet to the recording unit by a first motor driving the conveyance unit;

a first detection unit provided on the upstream side of the recording unit in the direction in which the sheet is conveyed, wherein the first detection unit detects whether there is the sheet;

a control unit that controls driving of a second motor for a roll sheet feeding unit among the plurality of feeding units, so as to convey a roll sheet fed from the roll sheet feeding unit; and at least one processor in communication with at least one memory storing computer-executable instructions which, when executed by the at least one processor, further causes the apparatus to function as:

a determination unit that determines which feeding unit among the plurality of feeding units feeds the sheet to the recording unit, wherein, if the first detection unit detects that there is the sheet, the control unit drives the second motor in a direction for rewinding the roll sheet with the sheet fixed by the conveyance unit, and the determination unit determines the feeding unit that feeds the sheet to the recording unit based on an output value associated with the driving of the second motor, which is output when the second motor is driven in the direction for rewinding the roll sheet with the sheet fixed by the conveyance unit.

2. The recording apparatus according to claim 1, wherein the plurality of feeding units includes the roll sheet feeding unit and a sheet feeding port that feeds a cut sheet.

3. The recording apparatus according to claim 1, wherein the plurality of feeding units includes a plurality of roll sheet feeding units.

4. The recording apparatus according to claim 1, wherein the at least one processor in communication with the at least one memory storing computer-executable instructions which, when executed by the at least one processor, further causes the apparatus to function as:

an identifying unit configured to identify an overload of the second motor based on the output value, wherein the determination unit determines the feeding unit that feeds the sheet to the recording unit based on whether the identifying unit identifies the overload when the second motor is driven in the direction for rewinding the roll sheet with the sheet fixed by the conveyance unit.

5. The recording apparatus according to claim 4, wherein, if the first detection unit detects that there is the sheet, the driving control unit increases a current value until the second motor reaches a specified speed with the conveyance unit fixed, and the identifying unit identifies the overload if the current value exceeds a set threshold value.

6. The recording apparatus according to claim 4, wherein, if the identifying unit identifies the overload when the second motor is driven in the direction for rewinding the roll sheet with the sheet fixed by the conveyance unit, the determination unit determines that the sheet is the roll sheet corresponding to the motor where this overload is identified.

7. The recording apparatus according to claim 4, wherein, if the identifying unit does not identify the overload when the second motor is driven in the direction for rewinding the roll sheet with the sheet fixed by the conveyance unit, the determination unit further determines that the roll sheet corresponding to the second motor where this overload is identified is located at a retraction position.

8. The recording apparatus according to claim 4, wherein, if the identifying unit does not identify the overload when the second motor is driven in the direction for rewinding the roll sheet with the sheet fixed by the conveyance unit, the determination unit determines that a cut sheet is fed.

9. The recording apparatus according to claim 1, further comprising a second detection unit provided in a vicinity of a feeding port of the roll sheet feeding unit that detects that there is the sheet, wherein the determination unit determines a source that feeds the sheet based on the output value associated with the driving of the second motor and a result of the detection by the second detection unit.

10. The recording apparatus according to claim 1, further comprising a sheet feeding control unit that controls a sheet feeding operation of the recording apparatus, wherein the sheet feeding control unit determines a mode of the sheet feeding operation according to a result of the determination by the determination unit.

11. The recording apparatus according to claim 1, further comprising a notifying unit that presents a notification indicating a result of the determination by the determination unit.

12. The recording apparatus according to claim 11, wherein the notifying unit displays a type of the sheet loaded on a platen and a type of the sheet in a retracted state distinguishably from each other.

13. The recording apparatus according to claim 1, wherein the determination unit makes the determination before a start of a sheet feeding operation.

14. The recording apparatus according to claim 1, wherein the determination unit makes the determination at least any timing among timings when a release lever is opened and the sheet is loaded, when the recording apparatus is powered on, and when the recording apparatus returns from sleep.

15. A method for determining a sheet on a recording apparatus comprising a plurality of feeding units each configured to feed a sheet, the method comprising:

conveying, with use of a conveyance unit provided on an upstream side of a recording unit in a direction in which the sheet is conveyed, wherein the conveyance unit conveys, the sheet to the recording unit by a first motor driving the conveyance unit;

detecting whether there is the sheet with use of a detection unit provided on the upstream side of the recording unit in the direction in which the sheet is conveyed;

performing control so as to control driving of a second motor for a roll sheet feeding unit among the plurality of feeding units, so as to convey a roll sheet fed from the roll sheet feeding unit; and determining which feeding unit among the plurality of feeding units feeds the sheet to the recording unit, wherein the control includes driving the second motor in a direction for rewinding the roll sheet with the sheet fixed by the conveyance unit, and the determining includes determining the feeding unit that feeds the sheet to the recording unit based on an output value associated with the driving of the second motor, which is output when the second motor is driven in the direction for rewinding the roll sheet with the sheet fixed by the conveyance unit, if it is detected that there is the sheet by the detecting.

16. The method according to claim 15, wherein the plurality of feeding units includes the roll sheet feeding unit and a sheet feeding port that feeds a cut sheet.

17. The method according to claim 15, wherein the plurality of feeding units includes a plurality of roll sheet feeding units.

18. The method according to claim 15, wherein the determining step further determines a source that feeds the sheet based on the output value associated with the driving of the second motor and a result of a detection by a second detection unit provided in a vicinity of a feeding port of the roll sheet feeding unit that detects that there is a sheet.

19. The method according to claim 15, further comprising performing control to control a sheet feeding control unit that controls a sheet feeding operation of the recording apparatus, wherein the sheet feeding control unit determines a mode of the sheet feeding operation according to a result of the determination by the determination unit.

20. The method according to claim 15, further comprising presenting a notification indicating a result of the determination by the determination unit via a notifying unit.

21. The method according to claim 20, wherein the notifying unit displays a type of the sheet loaded on a platen and a type of the sheet in a retracted state distinguishably from each other.

22. The method according to claim 15, wherein the determining step is made before a start of a sheet feeding operation.

23. The method according to claim 15, wherein the determining step is made at least any timing among timings when a release lever is opened and the sheet is loaded, when the recording apparatus is powered on, and when the recording apparatus returns from sleep.

24. The method according to claim 15, further comprising:

identifying an overload of the second motor based on the output value, wherein the determining step determines the feeding unit that feeds the sheet to the recording unit based on whether the identifying step identifies the overload when the second motor is driven in the direction for rewinding the roll sheet with the sheet fixed by the conveyance unit.

25. The method according to claim 24, wherein, if the detecting step detects that there is the sheet, the control is performed to increase a current value until the second motor reaches a specified speed with the conveyance unit fixed, and the identifying step identifies the overload if the current value exceeds a set threshold value.

26. The method according to claim 24, wherein, if the identifying step identifies the overload when the second motor is driven in the direction for rewinding the roll sheet with the sheet fixed by the conveyance unit, the determining step determines that the sheet is the roll sheet corresponding to the motor where the overload is identified.

27. The method according to claim 24, wherein, if the identifying step does not identify the overload when the second motor is driven in the direction for rewinding the roll sheet with the sheet fixed by the conveyance unit, the determining step further determines that the roll sheet corresponding to the motor where the overload is identified is located at a retraction position.

28. The method according to claim 24, wherein, if the identifying step does not identify the overload when the second motor is driven in the direction for rewinding the roll sheet with the sheet fixed by the conveyance unit, the determining step determines that a cut sheet is fed.

* * * * *